United States Patent [19]

DeMichele

[11] Patent Number: 5,007,324

[45] Date of Patent: Apr. 16, 1991

[54] SPECIAL EFFECTS CONTROL FOR PORTABLE MUSICAL INSTRUMENT

[76] Inventor: Glenn DeMichele, 2217 West Leland Ave., Chicago, Ill. 60625

[21] Appl. No.: 347,815

[22] Filed: May 14, 1989

[51] Int. Cl.[5] ..... G10H 1/46; G10H 1/02

[52] U.S. Cl. ..... 84/741; 84/477 R; 84/DIG. 26

[58] Field of Search ..... 84/626, 630, 633, 662, 84/665, 701, 707, 711, 737, 741, 477 R, DIG. 26

[56] References Cited

U.S. PATENT DOCUMENTS

| | | | |
|---|---|---|---|
| 3,544,696 | 12/1970 | Broussard | 84/741 X |
| 3,781,451 | 12/1973 | Nolan | 84/741 X |
| 3,823,245 | 7/1974 | Suzuki | 84/741 X |
| 4,305,320 | 12/1981 | Peavey | 84/737 |
| 4,361,067 | 11/1982 | Ishii | 84/633 |
| 4,418,599 | 12/1983 | Raskin | 84/741 X |
| 4,545,278 | 10/1985 | Gagon et al. | 84/741 X |
| 4,586,417 | 5/1986 | Kato et al. | 84/630 |
| 4,699,038 | 10/1987 | Wedge | 84/665 X |

*Primary Examiner*—W. B. Perkey

*Attorney, Agent, or Firm*—Wallenstein, Wagner & Hattis, Ltd.

[57] ABSTRACT

A portable musical instrument and associated therewith a radio frequency transmitter for broadcasting to a remote receiver and audio amplifier the sounds generated by the instrument. The user-operated controls vary the sound level sent by the transmitter, vary the mixing of sound levels from pickup groups such as neck and bridge groups of an electrical guitar, and provide control signals for controlling a sound processing unit such as a reverberator associated with the audio power amplifier system. The immediate status of the gain and fader settings is relayed as an ultrasonic modulation on the portable transmitter to actuate unique display conditions in a delay element actuated from the fixed receiver to provide to the user an indication of the status of his settings. Low battery conditions in the transmitter battery unit cause unique signal conditions to be sent to the receiver, resulting in a readily visible warning display configuration. The currently selected mode, e.g., reverberation mode of an associated audio signal processor is also characterized by the unique readily visible display. System control in the portable unit is under microprocessor control, the microprocessor going to a dormant power-conserving mode when changes in instrument status or audio processor mode selection is not being commanded. A low state in the lithium battery in the transmitter system microprocessor results in a unique signal condition being transmitted to the remote unit to provide a corresponding display to warn the user of incipient battery failure.

45 Claims, 24 Drawing Sheets

SPECIAL EFFECTS CONTROL FOR PORTABLE MUSICAL INSTRUMENT

DESCRIPTION

1. Technical Field

The technical field of the invention is portable electrical musical instruments and special effects controls therefor.

2. Background of the Invention

Portable musical instruments such as an electrical guitar having one or more sound-sensing pickup groups (neck and bridge) are frequently provided in "cordless" form using an FM transmitter to transmit the musical sounds produced to a remote FM receiver forming part of a base unit. The receiver in turn drives an associated power amplifier through a loud speaker system located at the base unit or elsewhere in the room involved. Prior art electric guitars of this type include a number of on-board controls including a volume control whereby the operator may adjust the strength of the audio signal modulating the transmitter to thereby control the sound output at the receiver system. Additionally, the more advanced electric guitars are provided with a pair of vibration sensing pickup groups, one located close to the neck of the guitar, and the other located close to the bridge. An on-board user-operated fader control is frequently provided which, according to the setting established, sends audible tone signals exclusively from the neck pickup group, exclusively from the bridge pickup group, or as an intermediate blending of the two sets of signals.

Frequently the user must perform under dim lighting conditions, with the result that the settings of such controls as the fader control and the volume control on the guitar cannot readily be seen. The best that the user of such a guitar can do by way of ascertaining the settings of such controls is by touching them. This is an unsatisfactory solution, since there is a likelihood of mistake in attempting to establish control settings by feel alone. A misinterpretation of volume control setting leading the operator to abnormally advance the setting thereof can have adverse consequences during a performance.

One solution (not heretofore used) would be to provide some form of bar-graph light-emitting diode (LED) readout on the guitar. This, however, has disadvantages. One is that cordless portable electric guitars are powered with self-contained batteries. Light-emitting diodes are notorious for bleeding down small batteries rapidly, particularly when multi-segment LED displays are employed. The second disadvantage is that they tend to distract audience attention from the musician, and towards the illuminated display on his guitar.

Accordingly, a method of providing readily distinguishable non-distracting status-indicating displays to the operator, and without requiring a concomitant excess battery drain if a cordless guitar is involved, would be highly desirable. Such status-indicating displays could also desirably uniquely include means for displaying a warning of a low battery condition in the transmitter power supply, as well as a low battery condition in the sealed-in internal battery of a microprocessor, assuming that such is employed in conjunction with the portable transmitter. Here again, additional LED displays on the guitar to display such warnings would suffer from the same previously cited disadvantages. Additionally, if such a flashing LED display were used to indicate a low battery condition in the transmitter power supply, not only would the flashing of the LED accelerate the bleed-down of the transmitter battery, but also could in the case of a very weak battery, pull the battery voltage sufficiently low with each pulse that the associated voltage regulator powering the transmitter drops momentarily out of regulation, possibly resulting in the transmission of spurious pulse signals to the receiver. These in turn may result in transmission of spurious pulses to the associated audio amplifier system.

At the base unit there is frequently provided some form of controllable sound-altering audio post-processor which can modify the received audio signals into the loudspeaker in a variety of prescribed ways. One such post-processor is a user-controllable reverberation unit, according to the settings of which single or multiple reverberations of the received audio information may be introduced. The corresponding setting controls are usually provided on the base unit, with the result that the strolling musician could not modify these sound effects without returning to the base unit. A luminous display in the form of an alphanumeric LED display is sometimes provided to give a visual indication of the setting of the post-processor.

Remote operation of such post processors has hitherto been accomplished by employing one form or another of user-operated remote switch, either in the form of a foot switch mounted on the floor, or alternatively a similarly cabled controller switch box which the musician may carry with him. Both such remote control systems essentially immobilize the musician when making post-processor adjustments, and render overall control of the system cumbersome because of the additional controls he must actuate either by hand or by foot in addition to operating the instrument itself, as well as the fader and volume controls affixed thereto.

The various aspects of the invention overcome these disadvantages and provide an unusually versatile musical instrument.

SUMMARY OF THE INVENTION

According to a feature of the invention, applicable to corded and cordless instruments, the sound status of the instrument is set by controls on the instrument, as for example, obtained by adjusting the volume or fader control, are indicated by indicating means on the base unit whose displays are visible to the musician as he strolls about. To this end, a series of status-indicating signals are fed to the base unit indicative of the instantaneous settings as the operator varies the associated controls. In a preferred form of the invention when a cordless instrument is used, these status-indicating signals are broadcast as supersonic pulse trains sent out from the FM transmitter within the instrument, the signals changing as the settings change. In such a case a remote FM receiver and an associated power amplifier at the base unit are powered from electrical power lines, and associated therewith is circuitry for responding to the received ultrasonic pulse trains.

The base unit is provided with signal-responsive luminous displays, preferably in the form of a segmented luminous alphanumeric display. This display unit shows on one format or another the instantaneous value of the gain setting or fader setting as the operator varies them. Since the luminous display is powered ultimately from the power lines, in the cordless instrument version of the invention its operation does not cause significant bleed-down of the transmitter battery power. The normal musical signals are transmitted in the normal audio portion of the FM signal transmission from the instrument. The operator may thus verify at a glance the settings made on his instrument.

According to related features of the cordless instrument form of the invention, the status of the transmitter main battery, typically a 9 volt battery, is sent out to be displayed on the base unit automatically on power-up of the instrument, to provide the user with an easily remotely visible readout of the battery voltage. Subsequently, an abnormally low battery voltages, from a 9 volt battery, or of a self-contained microprocessor lithium battery, cause automatic actuation of serial signal strings, causing unique warning displays to be outputted at the base unit.

According to a feature of the invention, upon receipt of an abnormally low transmitter battery warning, the base unit causes subsequent displays to be presented in flashing form as a continuous warning.

In accordance with another feature of the invention, control of an audio post-processor in the base unit is operator controllable from controls affixed to his instrument through generation of selected command signal conditions transmitted to the post-processor to establish the desired degree of reverberation or other post-processor control sound variable. These command signal conditions, in common with the previously mentioned instrument status-indicating signal conditions, are all in the form of serial pulse trains, which in the cordless version of the invention are preferably ultrasonic pulse trains. These are analyzed and acted upon by a microprocessor-based control unit associated with the base unit. The post-processing option, e.g. reverberation setting, is displayed each time the operator commands a change thereof.

In the preferred form of the invention the instrument-mounted controls for varying the volume and fader conditions, as well as the controls for generating the operator-selected command signal conditions to control the audio-post processor, are all consolidated in a single group of touch buttons mounted on the instrument. Operation of the buttons either singly or in a prescribed sequence will cause the volume setting and the fader setting to vary on command, cause status-indicating signals to be sent to the display, command a change of status of the audio-post processor, and bring the transmitter to a power-up and power-off condition. Thus, in the preferred form of the invention, the operator is able to establish at a glance the operating conditions established by the touch buttons, the settings of the microprocessor, and low battery conditions at the transmitter and the base unit, all without posing serious drain on the transmitter battery. Since power is not a consideration at the base unit, the alphanumeric display, preferably a multi-element LED display actuatable to display a great variety of numbers, digits, and special symbols, may be made quite large so as to provide a readily visible representation of the operative status of the system. Moreover, the status of both the instrument and the base unit post-processing system are reflected in the status of a common display, again simplifying interpretation by the operator.

Other features and advantages of the invention will become apparent upon making reference to the specification, claims and drawings to follow.

BRIEF DESCRIPTION OF SEVERAL VIEWS OF DRAWINGS

DETAILED DESCRIPTION

I. System Overview

The present invention augments a conventional portable instrument radio transmitter-receiver system by generating status-indicating control signals in the form of ultrasonic pulse bursts superimposed upon the audio musical tone signals, the coding of these bursts representing the instantaneous state of the volume control setting or the fader control setting attendant to each change thereof. At the receiver appropriate filters split off these ultrasonic code bursts, and under microprocessor control they are decoded, and send to a visible light-emitting display a unique symbol corresponding to the status condition being transmitted. Thus, attendant to a movement of the volume control towards an increased gain position, a corresponding sequential series of coded patterns will appear on the light-emitting display indicative of the volume level as it rises. In addition to status information concerning the user-established status of the instrument, additional codes are also transmitted indicative of battery condition in the transmitter and in the control circuitry associated with the receiver control system. Additionally the settings of an audio post-processor associated with the receiver are user-controllable by a series of chosen transmitted signal commands (signal-alteration commands) which, suitably decoded by the receiver control circuitry are sent to the post-processing unit to control the setting, e.g. the reverberation time, thereof. Simultaneously a corresponding display is produced at the light-emitting display unit confirming the mode into which the post-processor has been set.

The discussion to follow centers on the exemplary form of the invention as applied to an electric guitar producing audio frequency tones by means of magnetic sensors in close proximity of the guitar strings; however, it will be evident to those of ordinary skill in the art that the principles of the invention may equally well be applied to other types of instruments, and in particular to instruments not necessarily specifically designed for electrical generation of audio tone signals. Thus, for example, a conventional guitar may be provided with one or more suitably placed contact microphones to supply such signals to the transmitter without departing from the scope of the invention.

Figure 1:
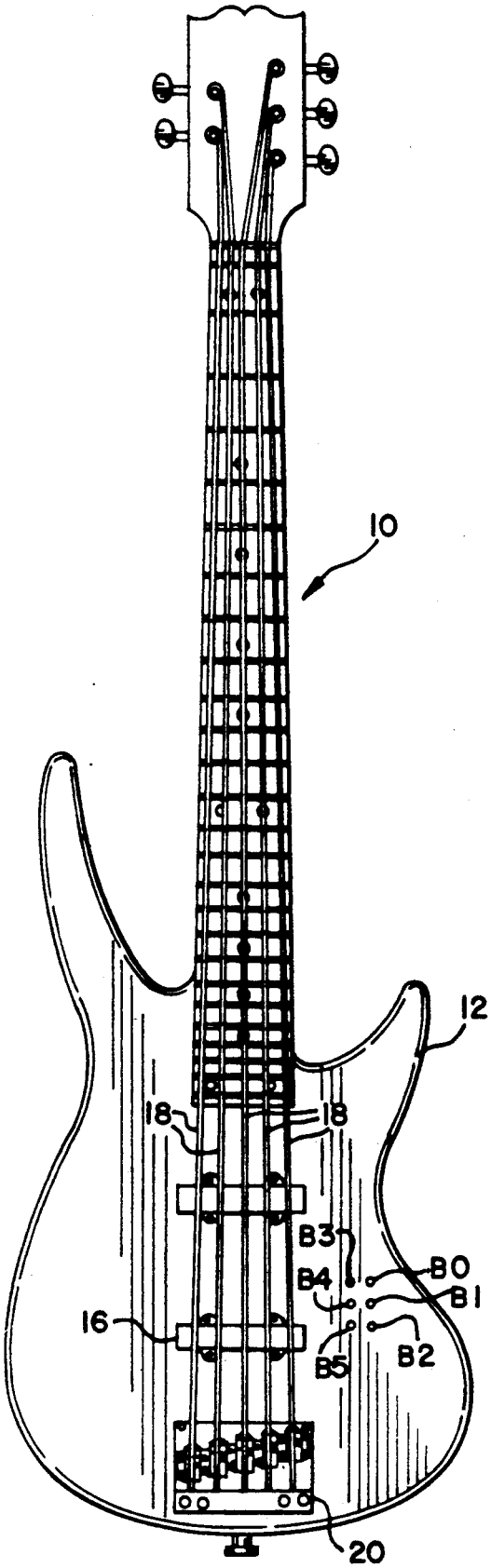
FIG. 1 is a front elevational view of an electric guitar incorporating features of the invention.
Figure 2:
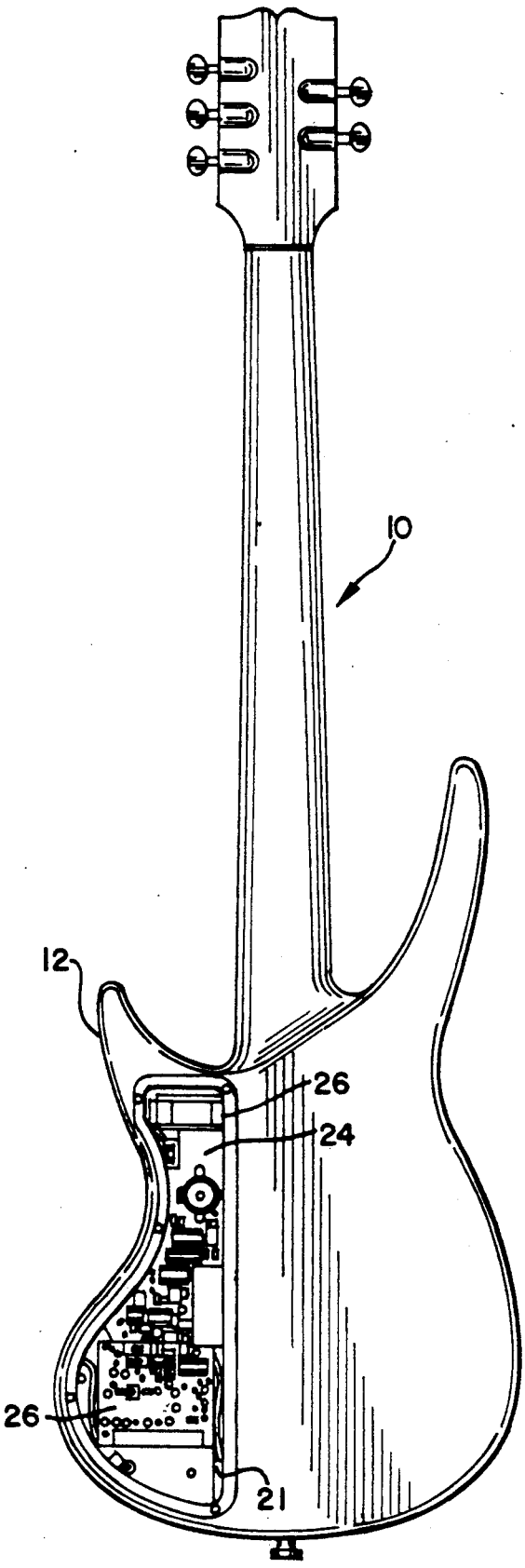
FIG. 2 is a rear elevational view of an electric guitar shown in FIG. 1.

Referring now to the Figures, FIGS. 1 and 2 show an electric guitar 10 having a housing 12. A neck pickup group 14 is located beneath the strings 18—18 near the neck of the guitar 10, and a bridge pickup group 16 is similarly placed below the strings 18—18 close to the bridge 20 of the guitar 10. As shown in FIG. 2, disposed within a well 21 within the guitar 10 are an FM transmitter 22, here taken to be a type WXY-10UT portable FM transmitter made by Yamaha, associated control circuitry 24, and a 9 volt system battery 26. On the front face of the guitar are located an array of 6 control push buttons B0–B5 operating on switches (not shown) associated with the transmitter control circuitry 24. Actuation of the switches, either individually or in a prescribed sequence controls a variety of functions in the guitar, including the previously mentioned volume control and fader control actions.

Figure 3:
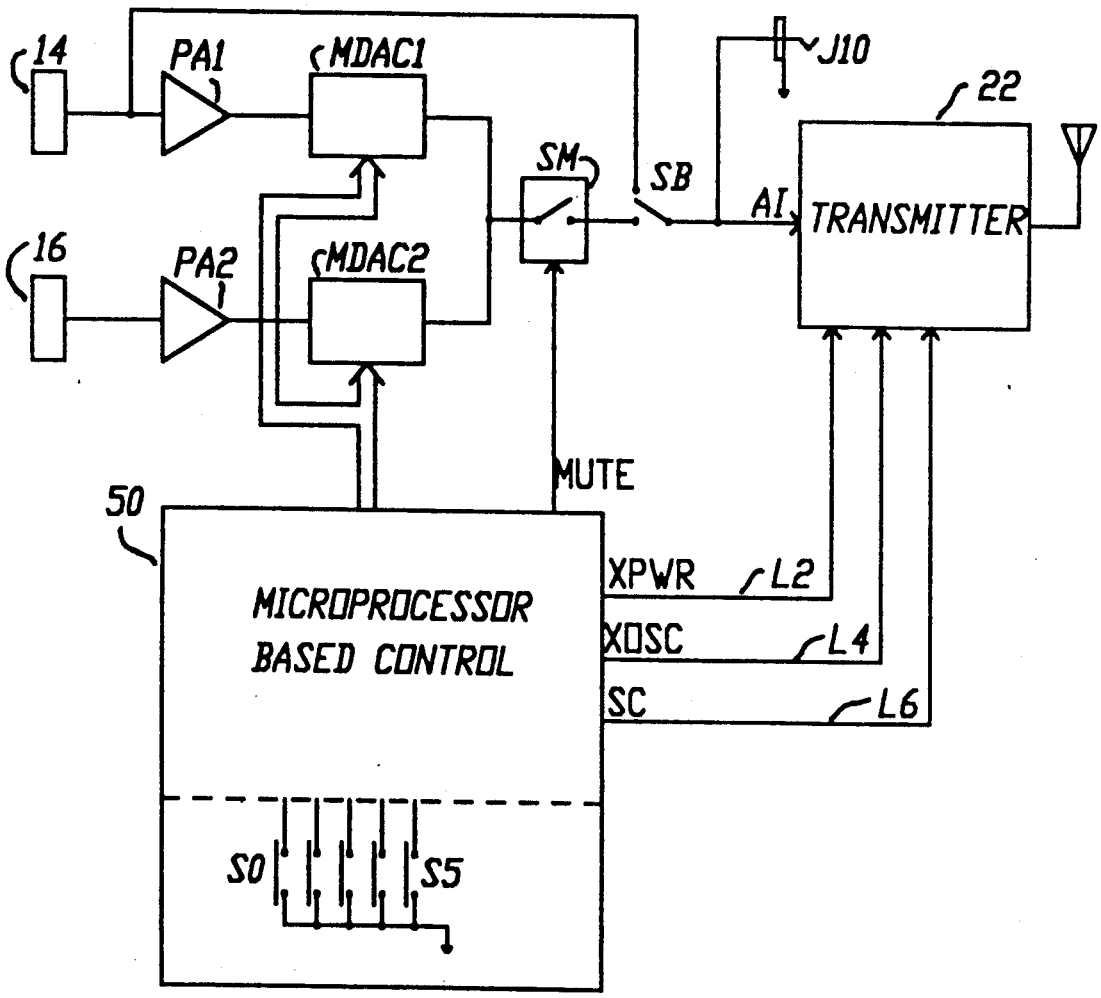
FIG. 3 is a block schematic diagram of a radio transmitter system incorporated into the guitar of FIGS. 1 and 2.
Figure 8:
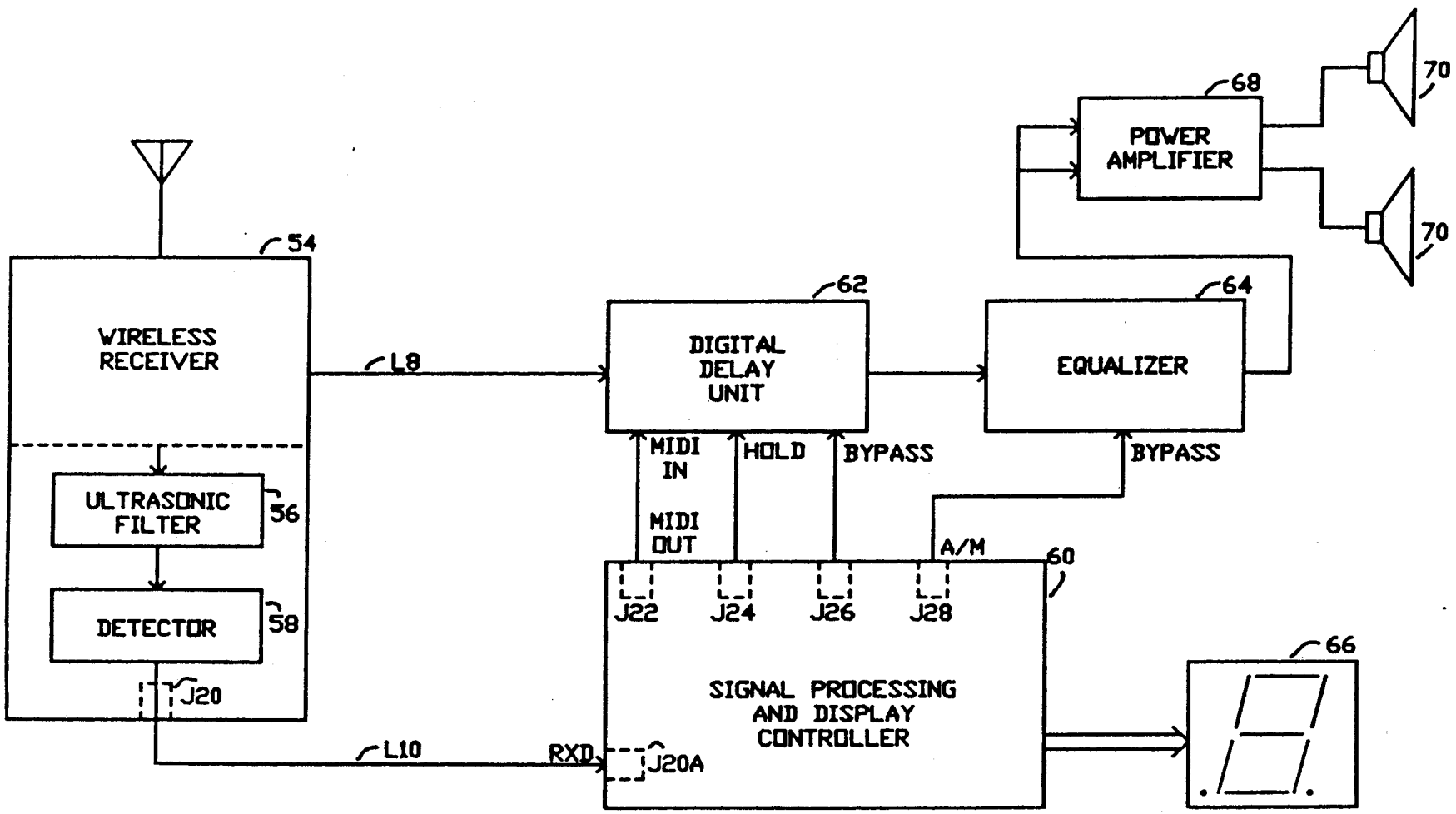
FIG. 8 is a block schematic diagram of a signal processing system for controlling the audio output received from a wireless receiver by commands transmitted by the transmitter s shown in FIGS. 3–7.

FIGS. 3 and 8 show in block diagrammatic form the principal elements of the transmitting system and the receiving system respectively. With respect to the transmitter, central control is exercised by a microprocessor-based control section 50 controlled by momentary actuation of switches S0–S5, these switches being operatively responsive to operation of the touch buttons B0–B5 shown in FIG. 1. Actuation of the appropriate switches in combination will place appropriate control signal conditions on the various lines exiting therefrom to serve a variety of purposes. Input signals coming from the guitar neck and bridge pickup groups 14, 16 are amplified through respective preamplifiers PA1, PA2 to be fed through associated multiplying digital-to-analog converters MDAC1, MDAC2 respectively. The individual gain settings of the converters MDAC1 and MDAC2 are controllably established by the microprocessor based control section 50, their outputs being summed and fed to an audio muting switch SM controlled by the control section 50, this audio output in turn being fed to the audio input of the wireless transmitter 22. A manual bypass switch SB is provided to pass the signals of the neck pickup group 14 to a conventional audio output jack in the event that simple non-radio communication is desired. Additionally, the control section 50 will provide upon actuation of suitable combination of the buttons S0–S5 battery power to the transmitter 52 over line L2, an oscillator enable condition over line L4, and ultrasonic pulse trains in the form of 40 kilocycle bursts of approximately 800 microseconds duration each to a specially configured ultrasonic modulation input of the transmitter 22 over line L6.

Referring now to FIG. 8, a modified wireless receiver 54, based upon the Yamaha type WXY-10R passes the audio frequency signals detected therein to a post-processor 62, here taken to be a digital delay unit, via line L8. The settings of this digital delay unit are established by a signal processing and display controller 60. The output of the delay unit 62 is then bypassed, if desired, through an equalizer 64, normally used to balance the sound output in terms of the room characteristics, this equalizer being operable to a signal-bypass condition responsively to signals received from the display controller 60. The output from the equalizer 64 is then fed to a stereo power amplifier 68 driving loud speakers 70—70. The ultrasonic bursts received by the wireless receiver 54 are split out through special control circuitry involving an ultrasonic filter 56 actuating a detector 58 to produce a binary command string sent to the display controller via line L10. A unique display condition is produced in a multi segment LED display 66 indicative of the binary pulse train received by the display controller 60.

II. Transmitter System

Figure 4:
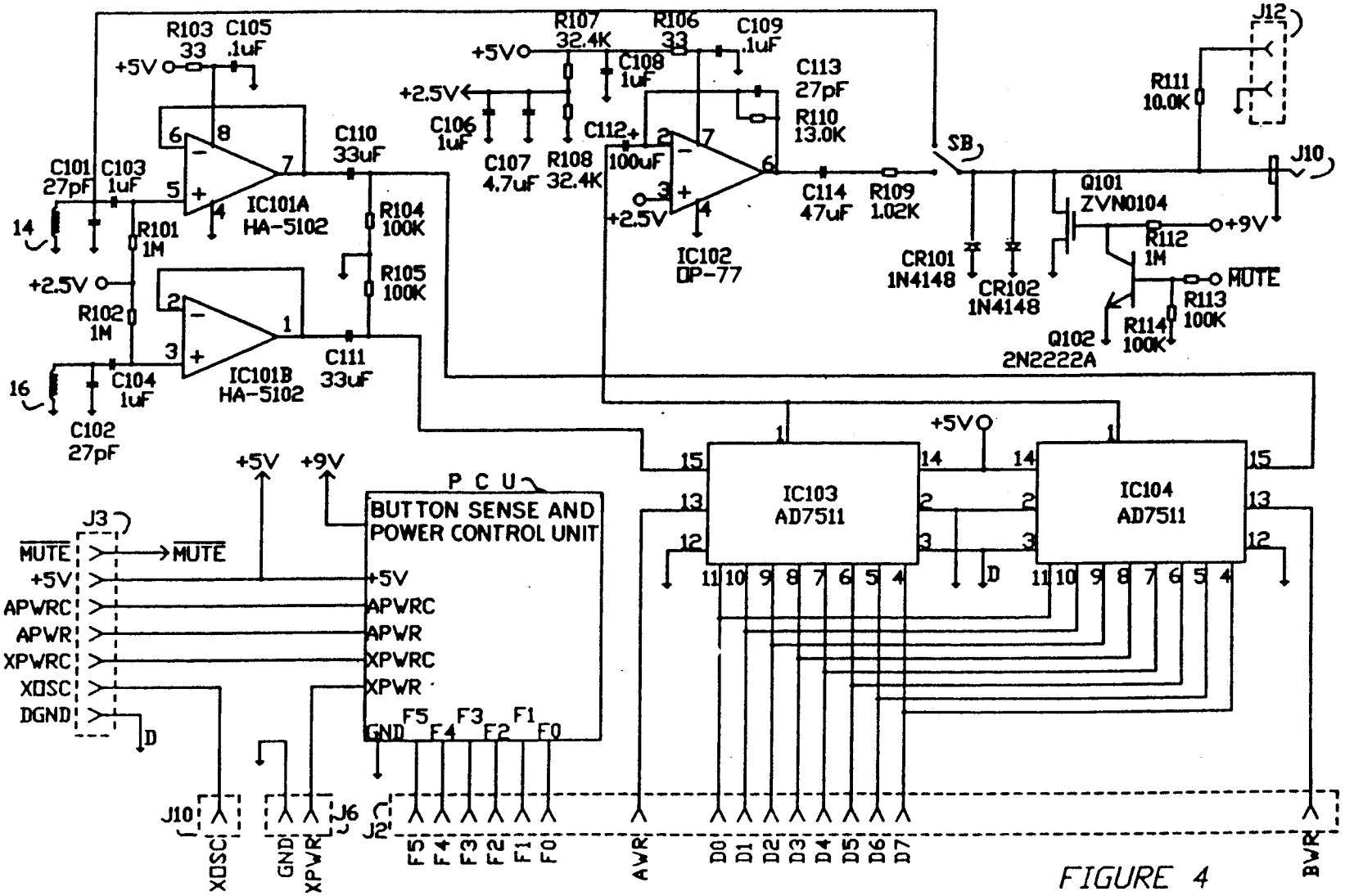
FIG. 4 is a schematic diagram of the transmitter system analog control section corresponding to a portion of the circuitry indicated in FIG. 3.
Figure 5:
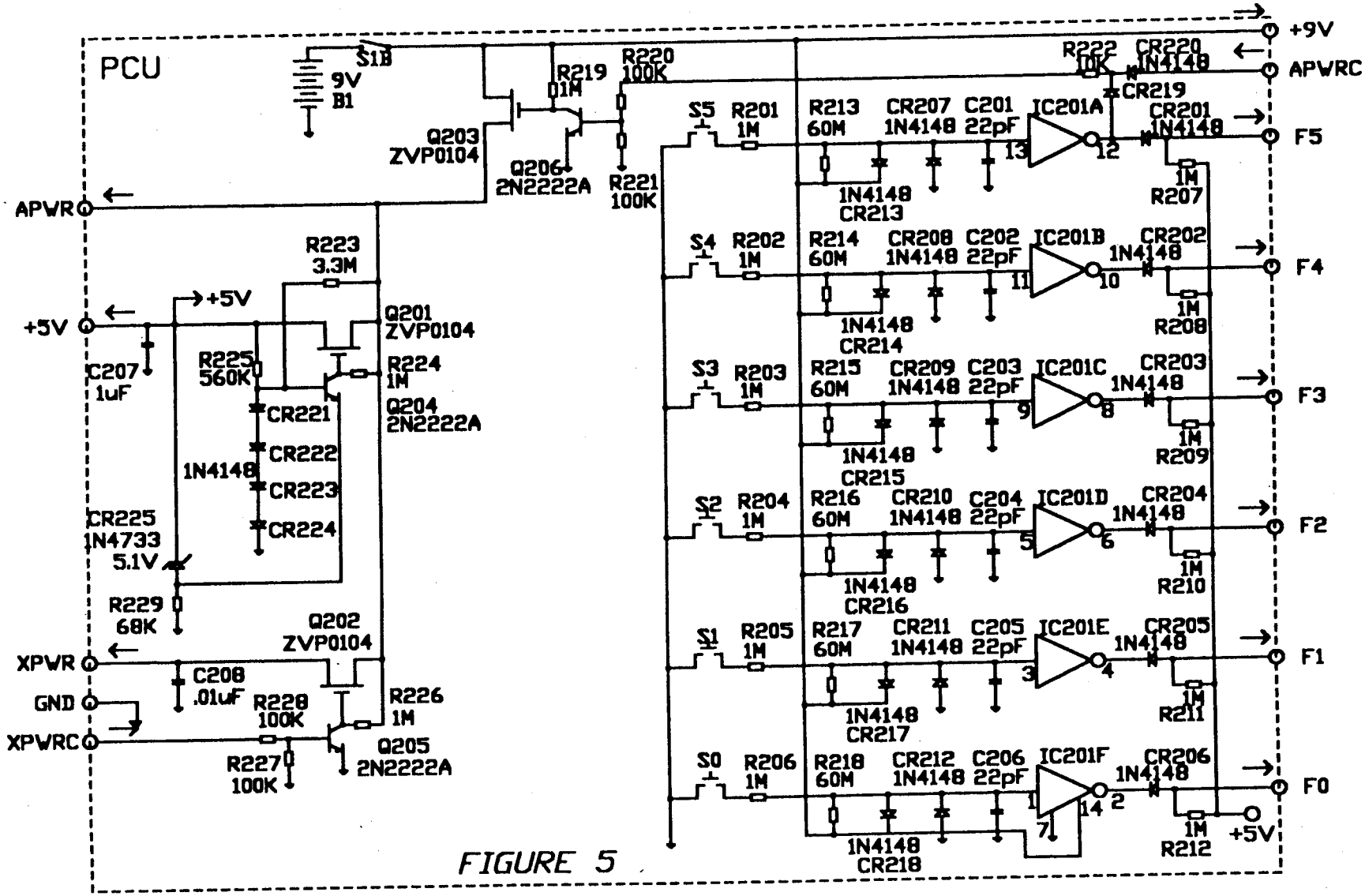
FIG. 5 is a schematic diagram corresponding to a button sense and power control unit shown in block diagrammatic form in FIG. 4.
Figure 6:
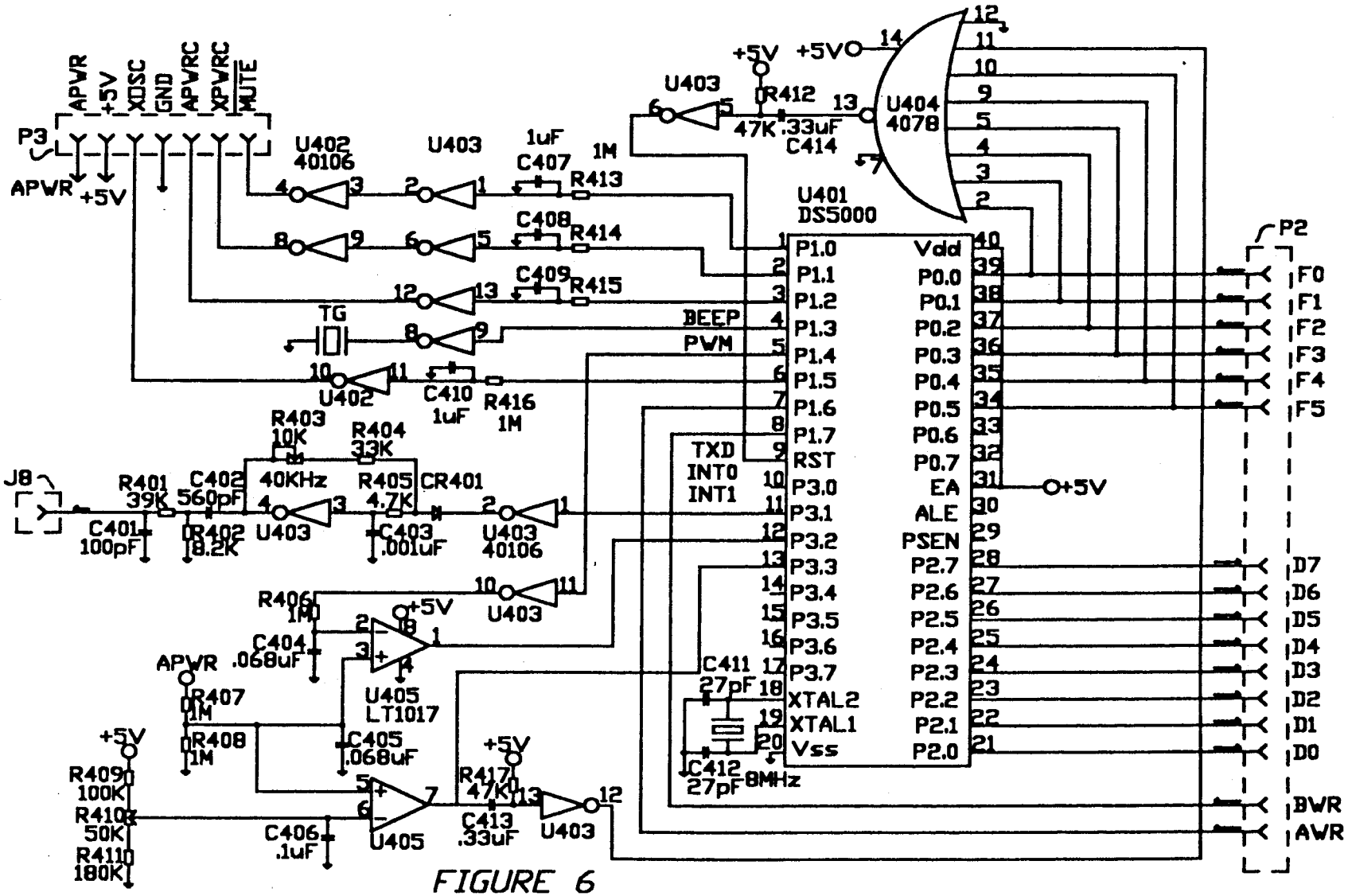
FIG. 6 is a schematic circuit of a transmitter digital control section representing portions of the circuit shown in FIG. 3 in block schematic form.

Considering the transmitter system in more detail, FIGS. 4, 5 and 6 show the control elements shown in block form in FIG. 3. Overall system control is governed by a microprocessor control section (FIG. 6) based upon microprocessor U401. Operator control of the microprocessor is established by actuation, either individually or sequentially, of switches S0–S5 (FIG. 5) of the power control unit PCU operatively associated with the buttons B0-B5 shown in FIG. 1. These button sensings are relayed to the microprocessor U404 (FIG. 6) via terminals F0–F5 of jack J2 to their counterpart terminals on plug P2 (FIG. 6). Responsively to such button sensings the microprocessor U401 responds to place appropriate output signals on terminals D0–D7 of plug P2 connected to similarly designated terminals of jack J2 (FIG. 4) to control the two multiplying digital-to-analog converters IC103, IC104. The individual settings of elements IC103 and IC104 will govern the balance and overall output amplitude of signals received from the pickups 14, 16 (FIG. 4).

The output signals from the two pickup groups 14, 16 are fed through respective preamplifiers IC101A, IC101B, their respective outputs being fed to the input terminals of IC104, IC103 respectively. The outputs of converters IC103, IC104 are tied together. Output level is set by the "gainword" established on terminals D0–D7. The summed outputs are sent through preamplifier IC102 to the normal audio input plug P12 of the wireless transmitter 52 from jack J12 (FIG. 4). A manual throw-over switch B is provided to allow non-electronic operation of the unit using only the pickup from group 14, this output being fed directly to a conventional audio output jack J10 for immediate wired connection to a local amplifier.

The output of preamp IC102 can be controllably muted by a low state received from the microprocessor U401 (FIG. 6) via plug P3 through jack J3 of the audio analog control section shown in FIG. 4. A low state so applied to the base of transistor Q102 allows the gate of transistor Q101 to be pulled to +9 volts, creating a low impedance shunt path effectively muting audio transfer to output jack J10 and J12.

A detailed treatment of the button sense and power control unit PCU will be deferred; however, there functions will be set forth in broad outline now. Interior circuitry of the button sense and power control unit PCU is shown in detail in FIG. 5. The function of the power control unit PCU is to respond to button sensings, i.e., the status of switches S0–S5, and to relay to these sensings to the microprocessor U401 via terminals F0–F5 of jack J2 to counterpart terminals F0–F5 of plug P2 shown in FIG. 6. Additionally, the power control unit PCU provides a regulated 5 volts to all systems as needed. Also, power control unit PCU provides the battery voltage to a comparator circuit in FIG. 6, the output of which provides the microprocessor U401 a pulse train indicative of the instantaneous voltage produced by the 9 volt battery B1 (FIG. 5). As will subsequently be discussed, these sensings provide an indication of the actual battery voltage, and hence the remaining battery life. Finally, the power control unit PCU gives power to the transmitter (FIG. 7B) via jack J6 (FIG. 4) to plug P6 responsively to microprocessor commands received from jack J3 on a transmitter power control line (XPWRC). In the power control unit PCU (FIG. 5) diodes CR201–CR224 are of the IN4148 type.

Turning now to the microprocessor control section (FIG. 6) in more detail, as previously stated it senses button sensings via terminals F0–F5 received at plug P2 and sends appropriate "gainwords" from output terminals D0–D7 of plug P2 to the multiplying converters IC103, IC104 (FIG. 4) via terminals D0–D7 of jack J2. The multipliers IC103, IC104 are selectively actuated to a storing state by appropriate signal conditions on the write lines AWR, BWR. Additionally, responsively to button sensings, the microprocessor U401 commands the transmitter to a power-on state by a control signal condition from port P1.1 via plug P3 to jack J3 (FIG. 4), thereby actuating the power control unit PCU to output 9 volts to jack J6 to energize the transmitter (FIG. 7B) at plug P6. Immediately thereafter the transmitter oscillator is enabled by a low state at port P1.5 of U401 sent to plug P3 and thence to jack J3 (FIG. 4) thence to jack J10 (FIG. 4) and finally to plug P10 of the transmitter (FIG. 7A).

It has been found desirable to turn the transmitter power on before enabling the oscillator upon power up so as to avoid an undesirable transient in the loudspeaker output. Similarly, on power down the oscillator is first disabled, and thereafter transmitter power is removed.

Figure 7A:
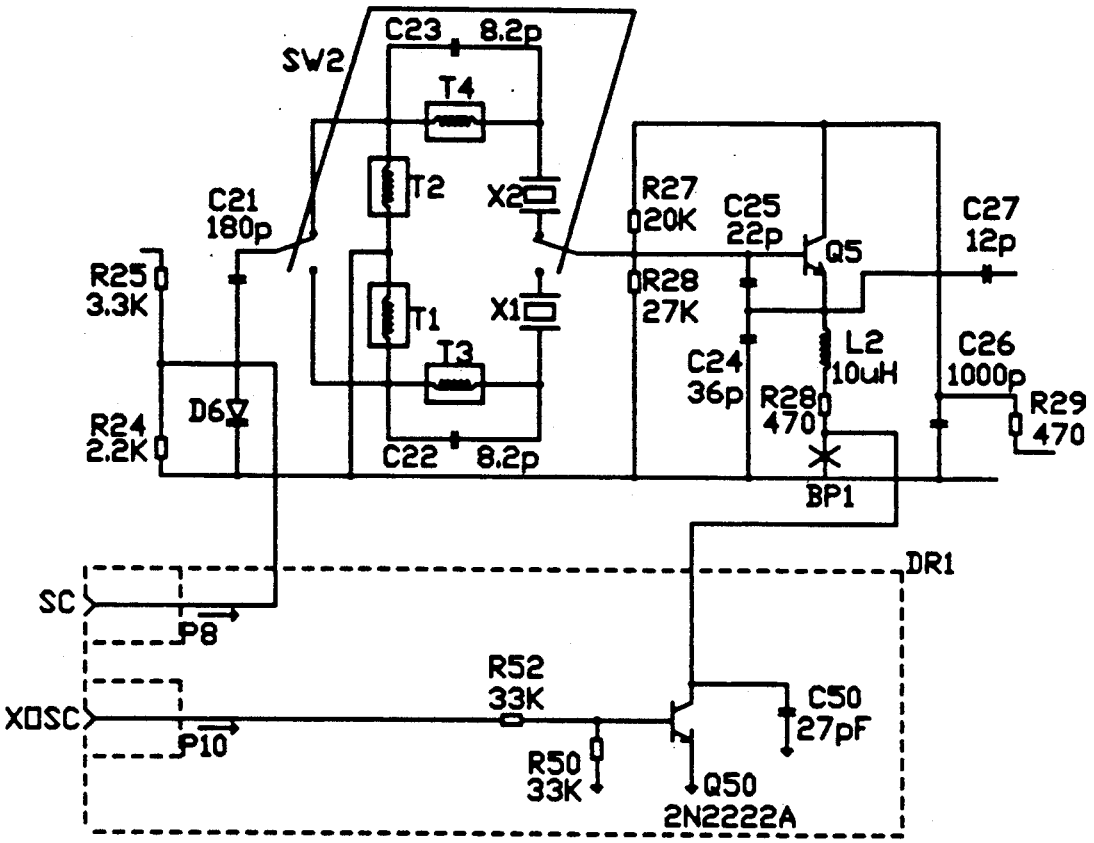
FIGS. 7A and 7B show modifications of a commercially available FM transmitter.

Central to the functioning of the microprocessor section (FIG. 6) is to send ultrasonic strings showing the status of the system, in particular signal conditions indicative of the "gainwords" currently stored in elements IC103, IC104 (FIG. 4), these binary strings being outputted from port P3.1 of microprocessor U401 converted into 40 kilohertz ultrasonic bursts sent out from jack J8 to plug P8 of the transmitter (FIG. 7A). These ultrasonic bursts act on varactor diode D6 of the transmitter to cause the frequency thereof to vary instantaneously with the amplitude of the 40 kilohertz bursts, thus providing an ultrasonic modulation of the normal carrier.

Considering the microprocessor section based on U401 (FIG. 6) in more detail and referring momentarily to FIG. 5, it will be seen that inputs of inverters IC201A, IC201F are normally held high at approximately 9 volts. As a result, output terminals F0–F5 are normally held low. Closure of any of the switches S0–S5 will cause its counterpart terminal F0–F5 to go high, resulting in replication of its status at one of the appropriate input ports P0.0–P0.5 and also resulting in a reset condition being applied to terminal 9 of U401. As will be discussed in more detail, this actuates the microprocessor U401 from a dormant low-current condition to an active state to begin program execution to act upon each button command as received. Further with respect to switches S0–S5, it will be evident to those of ordinary skill in the art that they need not be of the bridging type shown in FIG. 5. Because of the very high resistance values of R201–R206, switches S0–S5 may be replaced by touch switches wherein externally accessible conductor elements centrally located in insulating buttons B0–B5 (FIG. 1) are connected to the leftmost ends of resistors R201–R206 respectively. If the operator places a portion of his hand in contact with a grounded structure, such as the metallic bridge structure 20 (FIG. 1) then touching any button will actuate its associated inverter IC201A–IC201F of FIG. 5.

Status information is provided in serial binary form at output port P3.1. These binary bits are fed through a Schmitt-type relaxation oscillator based on inverter U403 to produce a 40 kilohertz square wave train responsively to each low state received from port P3.1. These 40 kilohertz pulse trains are converted to 40 kilohertz sinusoidal bursts by high pass filter C402, R402 and a low-pass filter R401, C401. Binary data strings may be optionally sent via port P1.3 to a tone generator TG, typically a piezoelectric buzzer providing audible indications to the operator that the unit is operating properly.

The actual voltage produced by the 9 volt battery B1 (FIG. 5) is measured by a signal conversion process. The battery voltage received at terminal PWR of plug P3 is divided by two and sent to the non-inverting input of comparator U405A. A pulse train is initiated and outputted at port P1.4 to be integrated by capacitor C404, resulting in a slowly rising voltage at the non-inverting input of comparator U405. This is accomplished by producing a pulse train having initially very short high states compared to the duration of the pulse train low states. The average value of this train is quite small, resulting in a very small voltage being developed across capacitor C404. The high or "on" time of the pulse train is established by a program-governed timing loop having a given initial seed number. The seed number is slowly increased to increase the wavetrain duty cycle. Thus, corresponding to each increasing value of seed number is a corresponding average value of the wavetrain voltage waveform and a corresponding dc voltage value developed across capacitor C404. Ultimately the voltage developed across capacitors C404 is equal to half of the battery voltage, causing triggering of comparator U405A and terminating the voltage-measuring process. The final value of the seed number is thus a measure of the battery voltage, and suitable algorithmic conversion reformats this number for transmission. The measure of the actual battery voltage may thus be sent on command as a binary string to the transmitter, actuating a corresponding display in the receiver.

A dangerously low voltage battery condition is monitored by comparator U405, resulting in a transition which will be responded to by NOR gate U404 in exactly the same as in the case of button actuation, i.e., the microprocessor U401 is awakened from its low current mode, a reset condition occurs at pin 9 of U401, and a corresponding warning signal condition is automatically broadcast as a serial string from port P3.1.

The control circuitry shown in FIGS. 4, 5 and 6 are designed for maximum power economy with respect to the battery B1 of the power control unit PCU (FIG. 5). The system master switch SIB is normally turned off for relatively long periods of non-use, namely six months or more. The microprocessor U401 (FIG. 6) normally rests in a dormant mode with the oscillator shut down, and will normally come down to an active status with the oscillator energized responsively to actuation of one of the switches S0–S5, or responsively to the presence of a low battery voltage condition.

In this dormant condition the analog control section (FIG. 4) remains active to output to the transmitter the signals received from the pickup groups 14, 16, properly weighted by the "gainwords" stored in the converters IC103, IC104. Under such conditions the amplifier control pin P1.2 of the microprocessor unit U401 will be low, resulting in a high state placed on the anode of rectifier of CR220 of the power control unit PCU (FIG. 5), thus energizing transistor Q206 to turn on transistor Q203, thus providing 9 volts to the regulator based upon transistors Q201, Q204. The output of this regulator provides regulated 5 volts to power the analog control circuit (FIG. 4), the microprocessor U401 (FIG. 6), and all remaining integrated circuits in FIG. 6. The microprocessor U401 is then actuated from a dormant to an active mode by placing a high state on any of the inputs of gate U404, driving pin 9 of U401 high, causing a reset operation jumping to location 0000 and turning on the microprocessor U401. Having performed the commanded function, program control causes the microprocessor U401 to again revert to the dormant mode to await the next actuation.

Total system shutdown is achieved by sequential actuation of switch S3 and S5, resulting in a high state being momentarily outputted at the amplifier power control terminal P1.2, this condition turning off transistors Q206 and 203, thereby removing the regulated 5 volt power from all related elements. The system is now shut down. It will be noted that inverters IC201A–IC201F remain active; however, since they are CMOS units, their power consumption is trivial.

To bring the system up to power from the completely shut down state, switch S5 (FIG. 5) is momentarily closed. This places a high state on the base of transistor Q206 through diode CR219, momentarily supplying system power to the 5 volt regulator. This action thus also supplies a regulated 5 volts to all elements shown in the microprocessor control circuit of FIG. 6. The microprocessor is now in a powered state, and the sensing of the closure of switch S5 is sensed at terminal F5 of plug P2, commanding a reset operation at pin 9 of the microprocessor U401, whereafter the amplifier power control terminal P1.2 is driven low to hold transistor Q206 of the power control unit PCU (FIG. 5) on. The system is thus momentarily powered up and the touring functions set by the program stored in the microprocessor U401 occur in sequence, followed by reversion to the dormant mode.

Figure 7B:
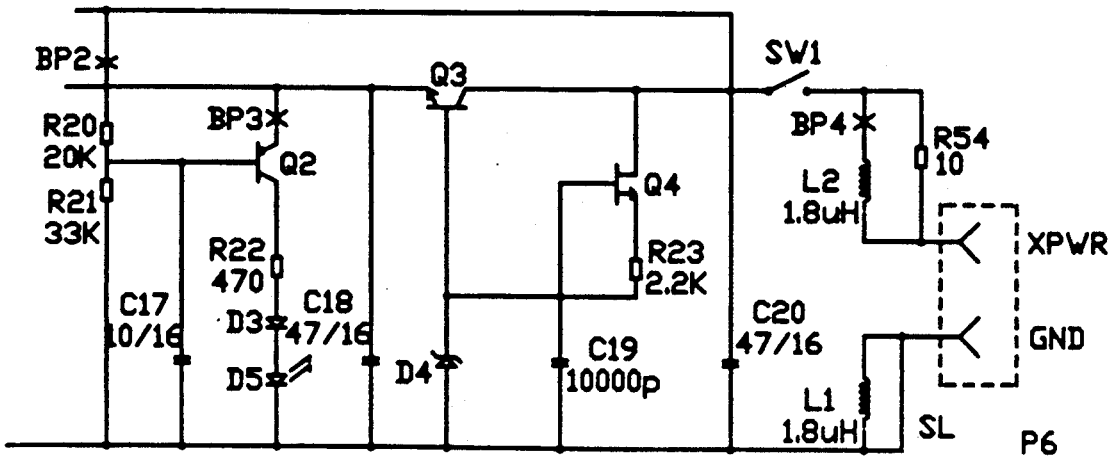

To further conserve battery power, FIG. 7B shows a preferred modification of the Yamaha type WXY-10UT wireless transmitter 22 shown in block form in FIG. 3. The light emitting diode D5 and its associated control circuitry are disconnected by breaking the appropriate leads as shown at break points BP2, BP3. The normal battery input connections are also modified as shown, power being supplied by the two terminals of plug P6. A shorting link SL is provided around inductor L1, inductor L2 being disconnected at break point BP4 and shunted by a resistor R54.

FIG. 7A shows the associated modifications of the wireless transmitter to allow the oscillator to be enabled or disabled according to a signal condition received at plug P10. With respect to the transmitter modifications shown in FIG. 7A, those elements within the dotted rectangle DR1 represent additional circuitry necessary to practice the invention. Resistor R28 is removed from ground by breaking its lead at breakpoint BP1, and its lower end is controllably grounded through transistor Q50 responsively to a high state received at plug P10. When a low state is received at P10 transistor Q50 is turned off, and the oscillator Q5 is accordingly disabled.

Table I is a listing of the programs to be stored in memory in the transmitter microprocessor U401 (FIG. 6). The listing shown is that prior to assembly by a Model 8051 cross-assembler version 3.0 currently marketed by 2500 A.D. Software, Inc. FIGS. 11A–11G show a program flow chart corresponding to the sequence of operations set forth in Table I. FIGS. 11A–11G and Table I will be self-explanatory to those skilled in the art; however certain system protocols will be discussed by way of clarification. Table II shows the format of the binary sequence outputted from port 3.1 of microprocessor U401 for transmission to the receiver responsively to actuation of the switches S0–S5. Start and stop bits are not included in the format representations. Also shown therein are the displays commanded at the receiver display unit 66 (FIG. 8). Thus, as previously discussed, momentarily closing switch S5 causes the system to power-up, supplying in particular a regulated 5 volts to all associated elements in the transmitter system. A special sequence of transmissions and corresponding displays are then sent out automatically, as will be discussed subsequently. System power shutdown is achieved by actuating switch S1, followed by actuating switch S3. Immediately prior to shutting down the transmitter system, the serial string 89 is sent by the transmitter, resulting in the visible display ".–.". Battery tests of the 9 volt battery level may be secured at any time by initially actuating switch S5, followed thereafter by actuation of switch S2. The transmitted format is the number 82 followed by the most significant digit, and then the least significant digit of the measured battery voltage. The most and least significant digits that are being displayed in sequence separated by a second or so. Thus, a battery voltage of 7.1 volts will result in a display of ".7." followed by the display ".1.". No special display results from turning the transmitter off or on.

Actuation of switch S0 will cause the gainwords stored in the multiplying converters IC103, IC104 to be decremented, resulting in the serial transmission of the number 80, followed by a normalized gain representing number and producing a corresponding display ".0" at minimum gain up to ".F" at maximum gain. To fade toward the neck switch S1 is held actuated, resulting in progressive decrementing of the gainword stored in IC104 and corresponding incrementing of the gainword stored in IC103 until switch S1 is released. During this process constantly changing serial string is transmitted in the form of the number 81 followed by a normalized single digit output representative of the fader status. The output display of "0." corresponds to output from the neck group only, a display of "F." corresponds to output from bridge group only, and a display of "7." corresponds to equal contribution from both groups. Equalizer bypass is achieved by closing switch S4, followed thereafter by closing switch S2, the transmitted serial string 83 followed by 14 causing the display ".A.". The commands "equalizer bypass" and "audio mute"

are both toggle operations, in that sequential operation of their corresponding switch commands will cause the equalizer and the audio mute to toggle between active and inactive states.

The Yamaha type D1500 audio processor 62 is operable between three different options, i.e., delay times, and they are selected by the switch combinations shown. Commanding "option 1" results in a display "1", etc. Instead of commanding the options by number, they may alternatively be commanded as increments or decrements with respect to their previous value. The corresponding display shows the new option number. The remainder of Table II is self-explanatory.

Considering next the special sequence of transmissions and displays attendant to turning on system power by closing switch S1, an immediate test is performed to establish the status of the lithium battery in the transmitter microprocessor U401. A power control register (PCON) continuously monitors the status of the lithium battery. If the lithium battery is low, a flag is set in PCON. As previously mentioned, in power up the transmitter is turned on briefly. The power control register PCON is immediately interrogated for the status of the lithium battery. If the lithium battery is low, the serial string 85 is transmitted to the receiver causing the display ".L.". In the preferred embodiment the Morse Code signal "LI" is also outputted to the tone generator from port P1.3 transmitter of the microprocessor U401. Programmatic jump then occurs putting the entire system into dormant mode. If the lithium battery voltage is adequate, then the string 88 is sent, resulting in the display .". and the system goes to power up. Immediately thereafter the voltage of the 9 volt battery is measured, and in the event that it is above a nominal 6 volts a tour of ports P0.0–P0.5 occurs. In the event that no change of line status occurs during a prescribed interval, the system again reverts to dormant mode. In the event that the 9 volt battery is less than the nominal 6 volts, the string 86 is outputted, the Morse equivalent of "LO" is outputted to the tone generator TG, and in response to the received string 86 the display ".b." is commanded, and the display will continue to flash all subsequent commands. This flash is controlled by a flag set in the receiver signal processing display controller 60 (FIG. 8), and all subsequent displays will accordingly respond to flash. Thereafter, as before, a tour of the button sensing lines at ports P0.0–P0.5 is carried out, and in the event that no response is received within a prescribed period of time, the system again reverts to dormant mode.

The system is further adapted so that at any time the microprocessor is in active mode, a battery voltage below 6 volts will cause the string 86 to be sent, initiating continuous flashing of whatever display is commanded. The power control register PCON is also internally configured to respond to an abnormally low voltage applied to the power pin 40 of microprocessor U401. In the event that this voltage drops below 4.5 volts, a flag is set in register PCON, resulting in automatic outputting of the serial string 87, commanding a display ".d.".

III. The Receiver System

Figure 9:
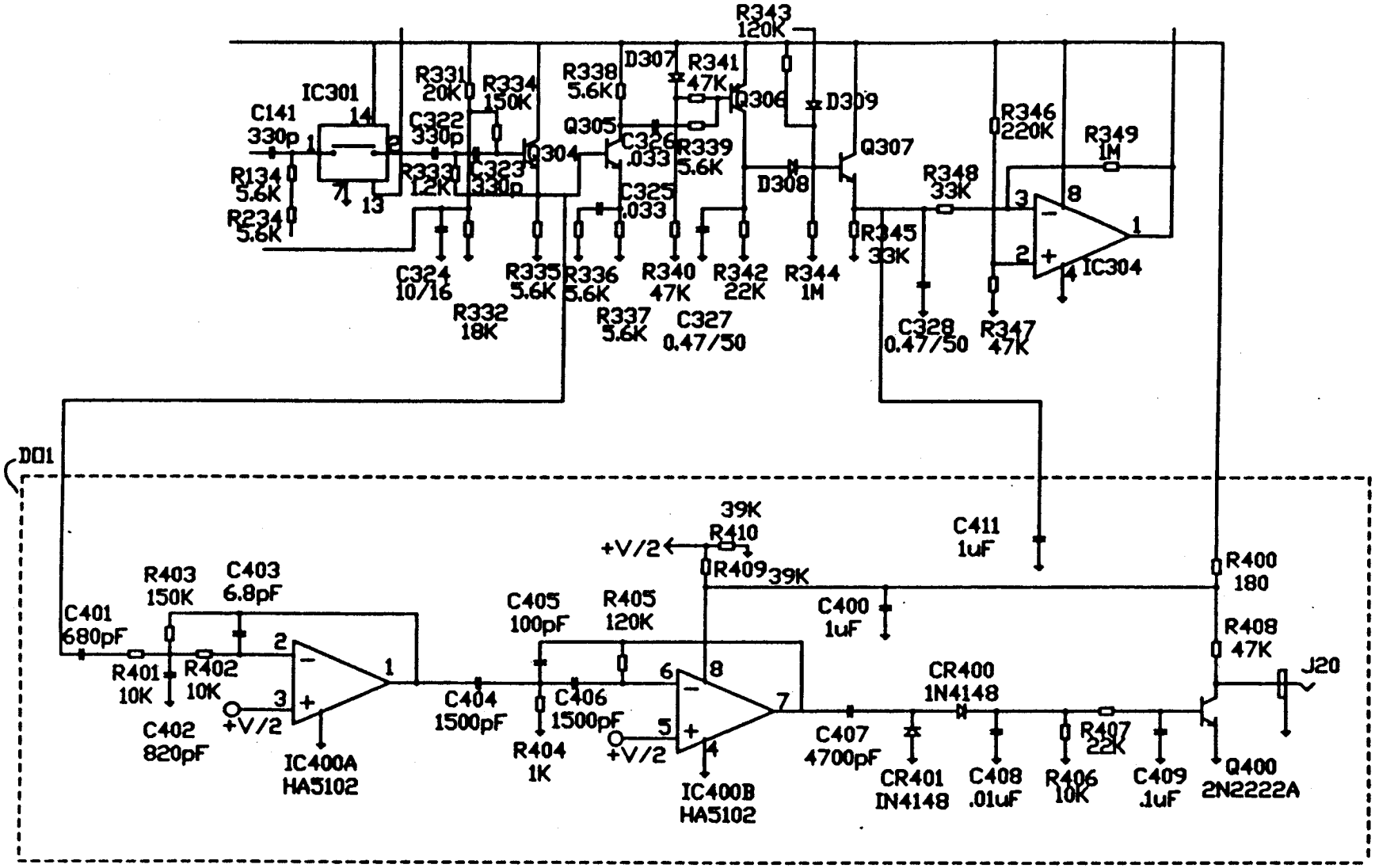
FIG. 9 is a schematic diagram of a commercially available FM receiver, showing modifications thereto to practice the instant invention.
Figure 10:
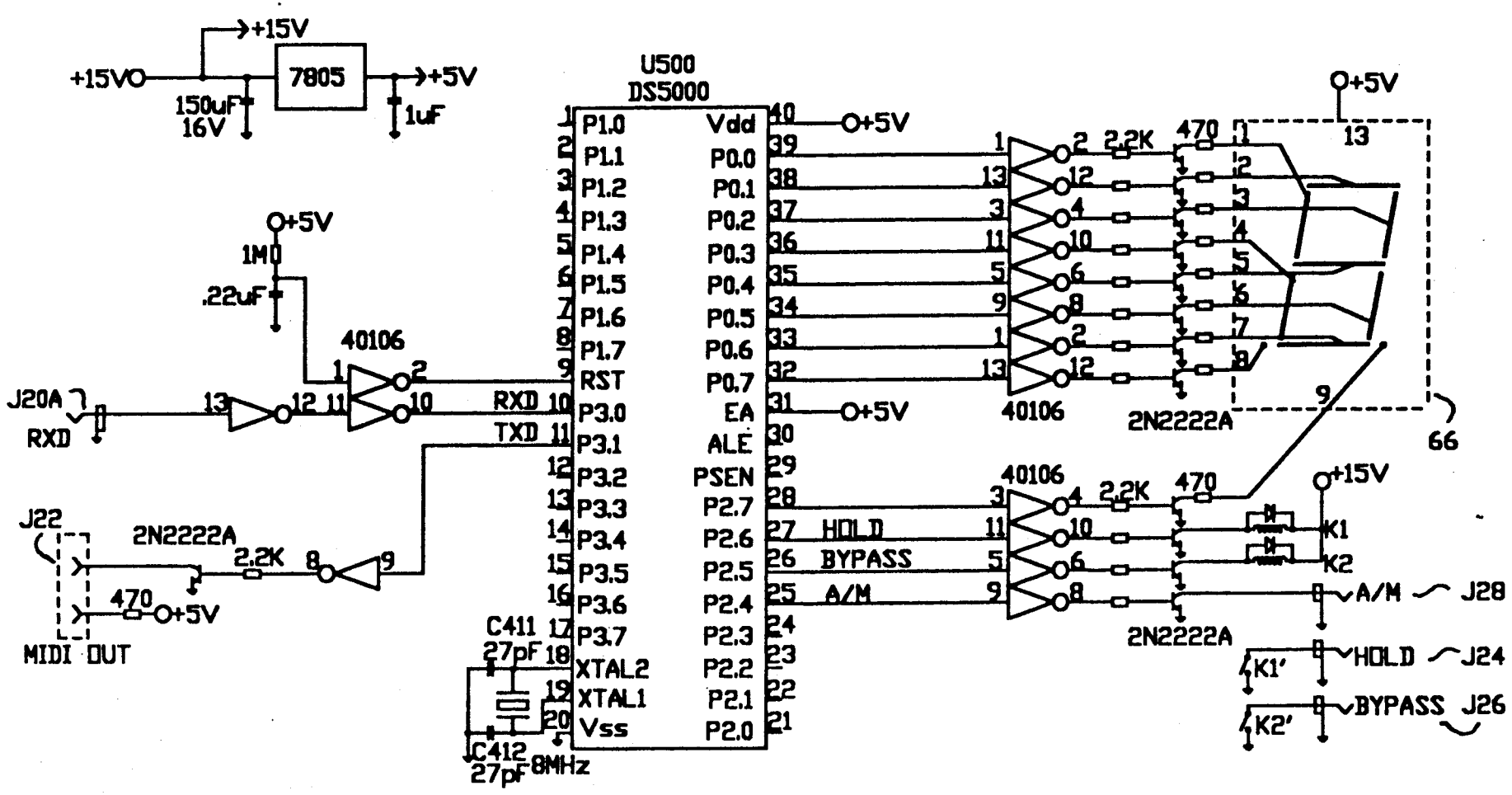
FIG. 10 is a schematic diagram of a signal processor and display controller shown in block schematic form in FIG. 8.
Figure 11A:
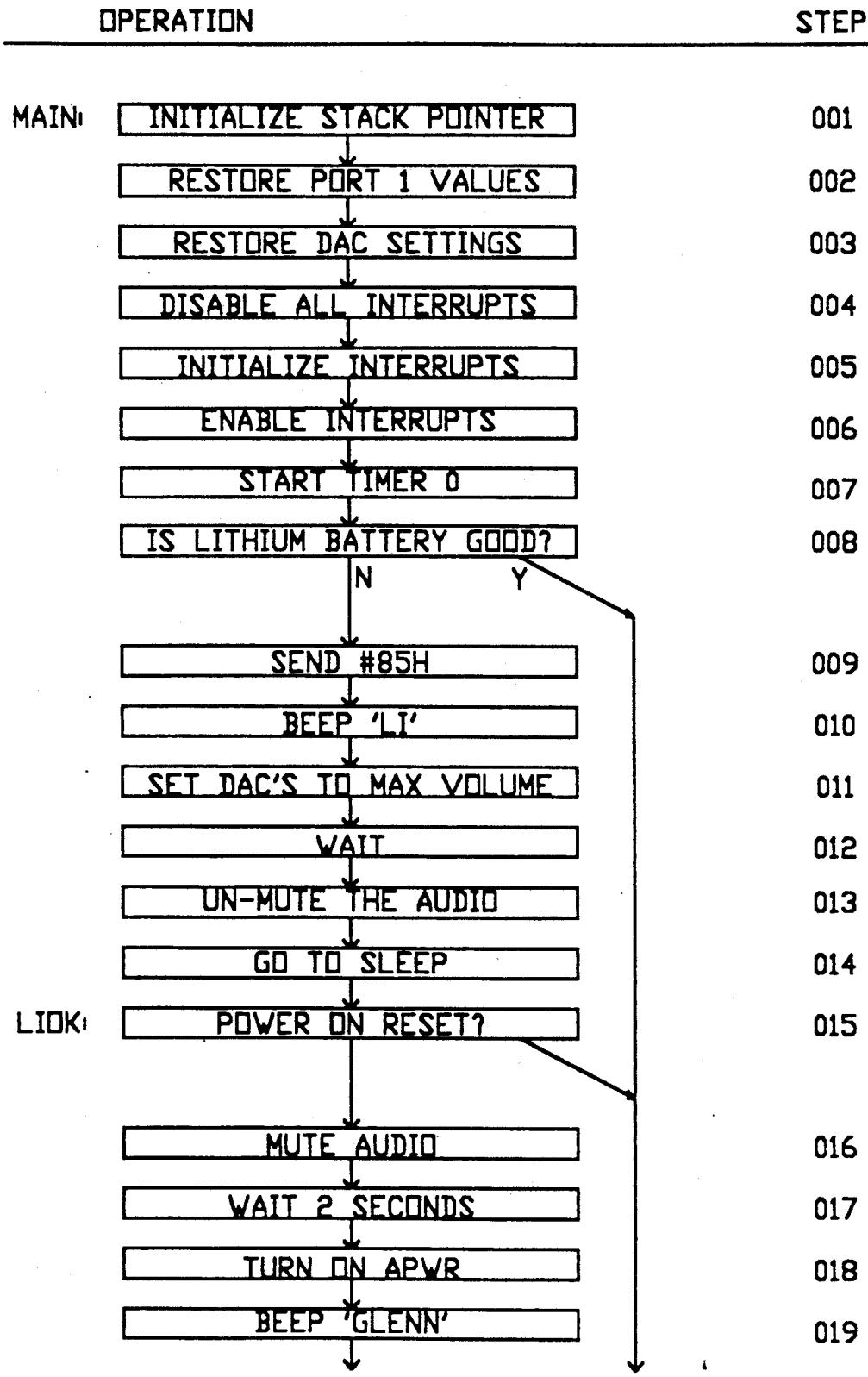
FIGS. 11A–11I represent a flow chart showing the microprocessor control of the transmitter show 6.
Figure 11B:
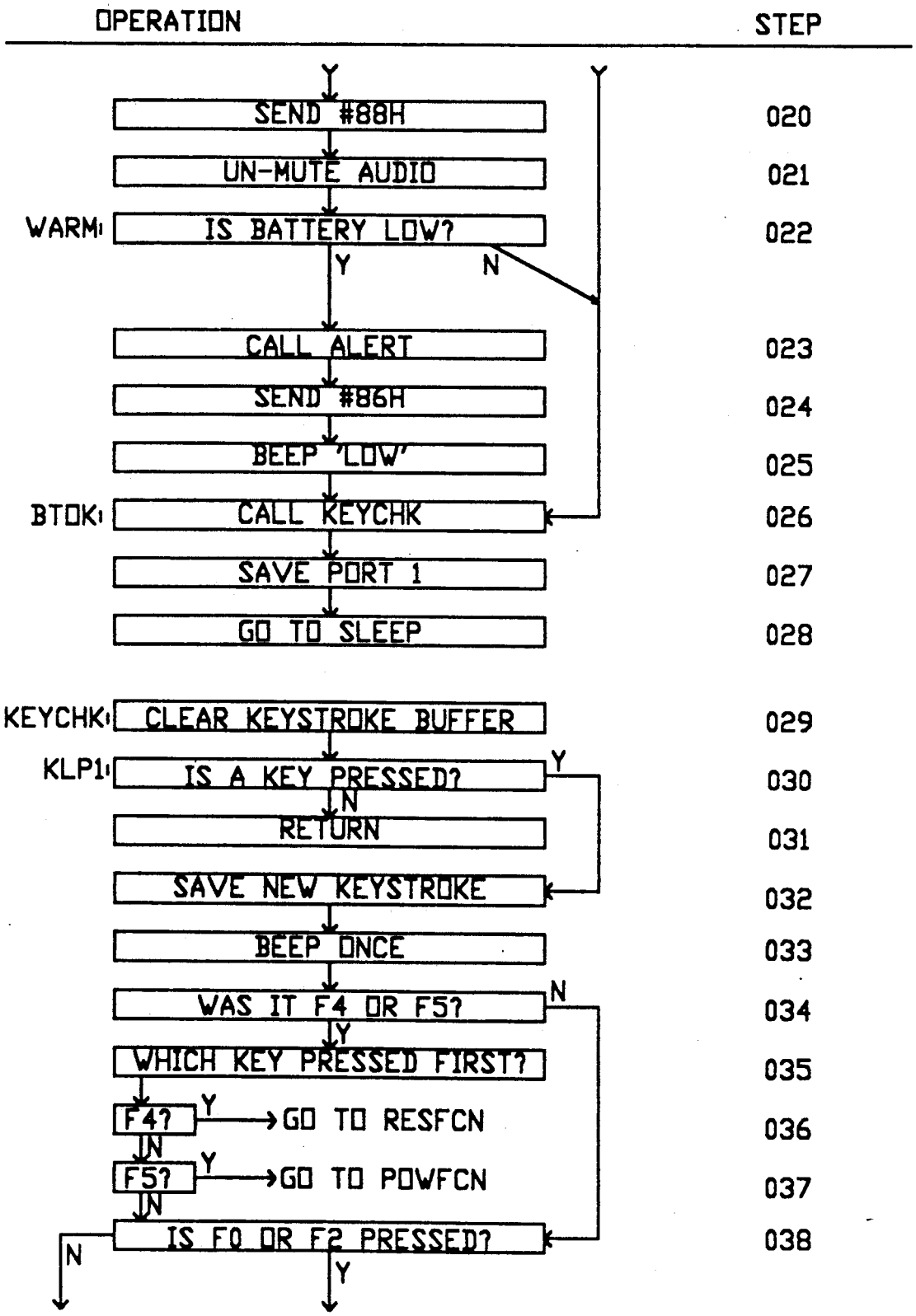
Figure 11C:
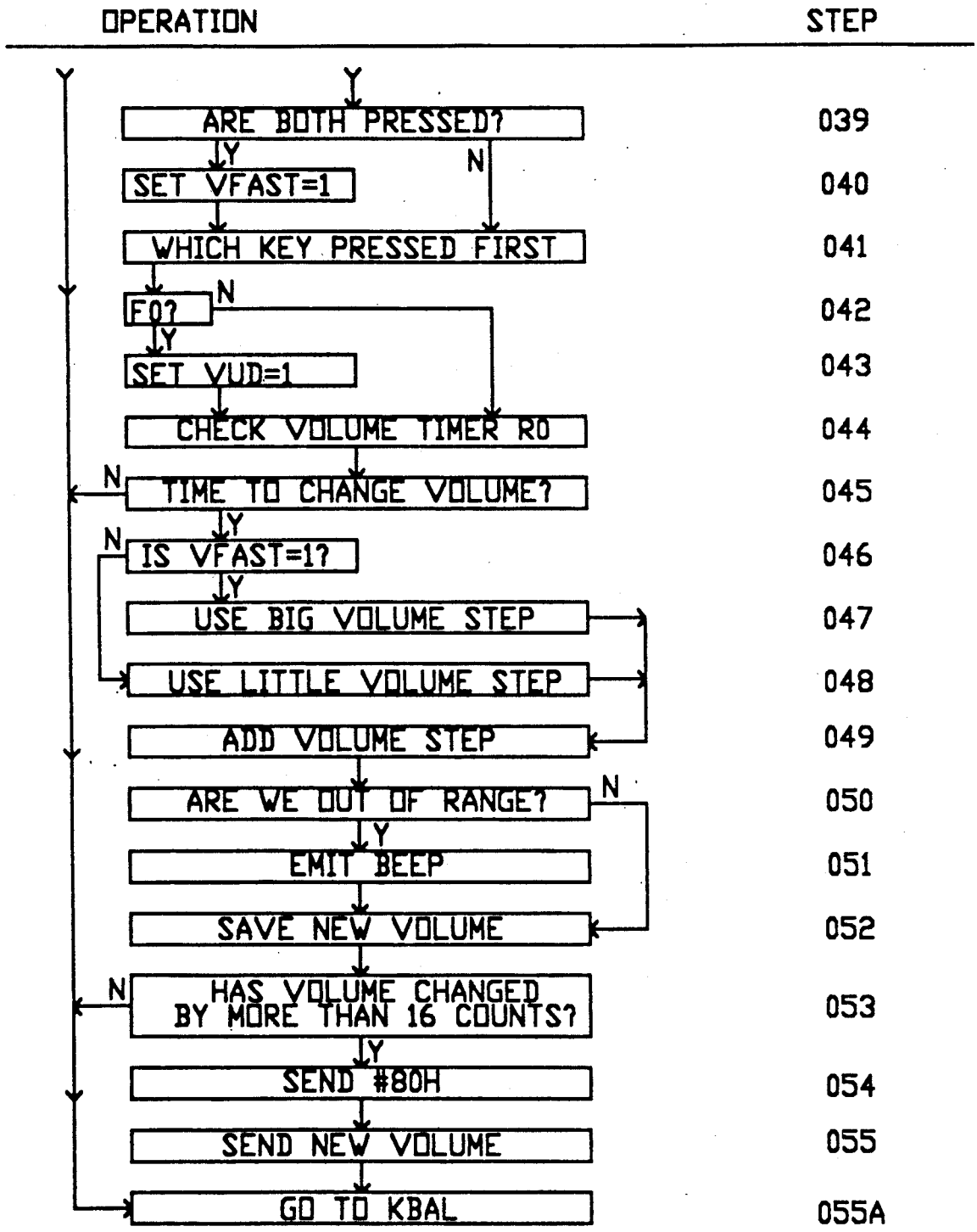
Figure 11D:
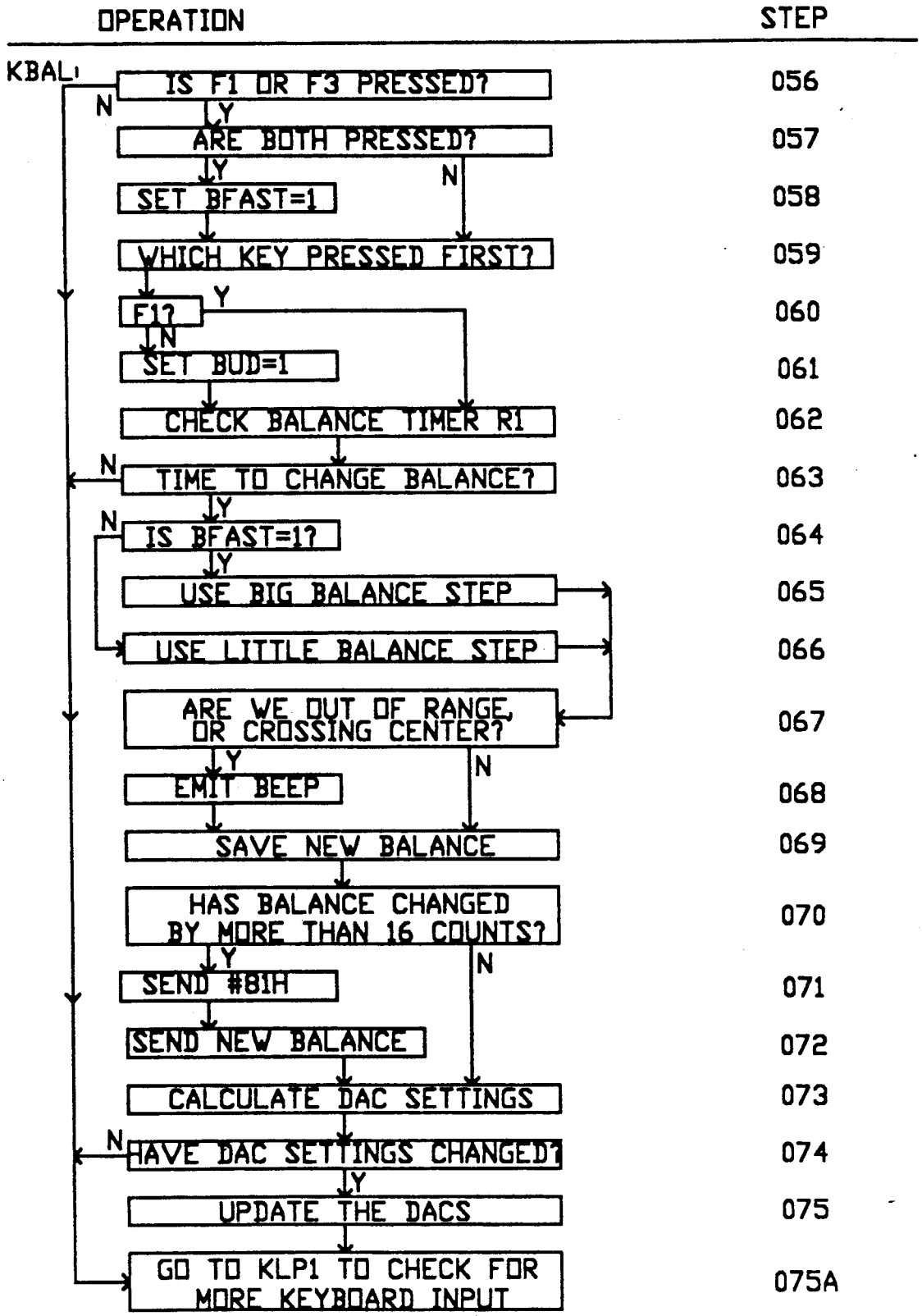
Figure 11E:
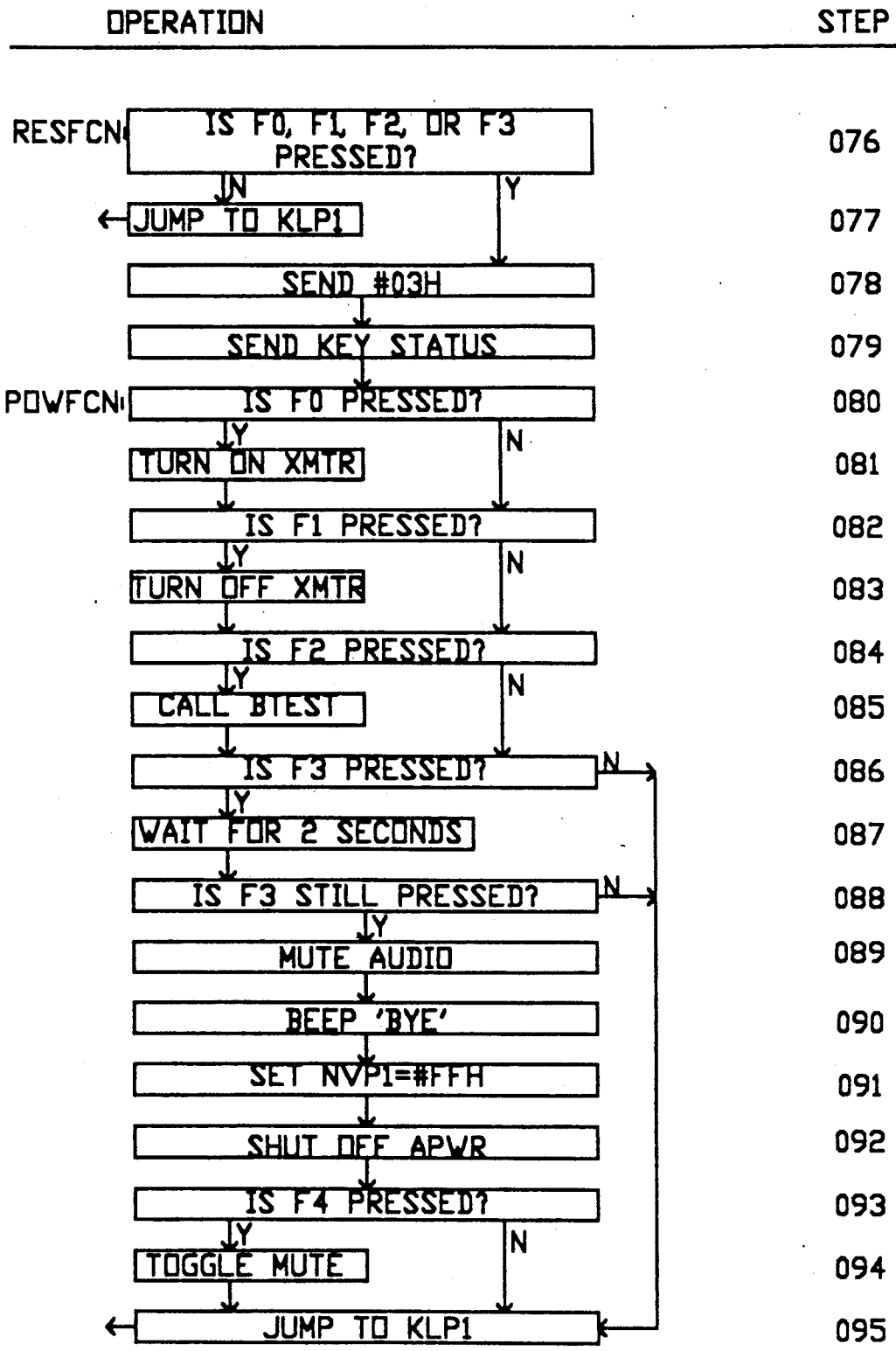
Figure 11F:
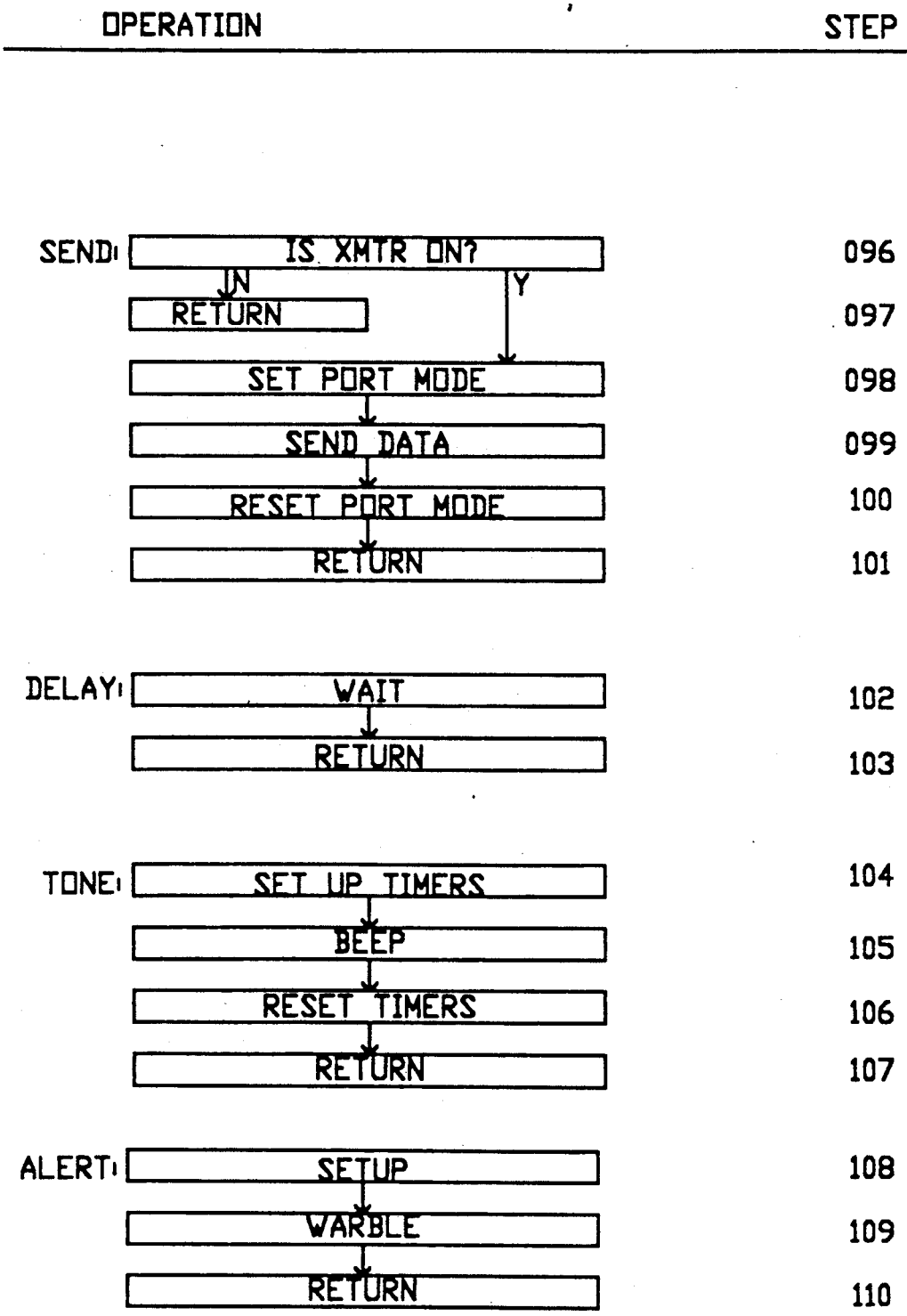
Figure 11G:
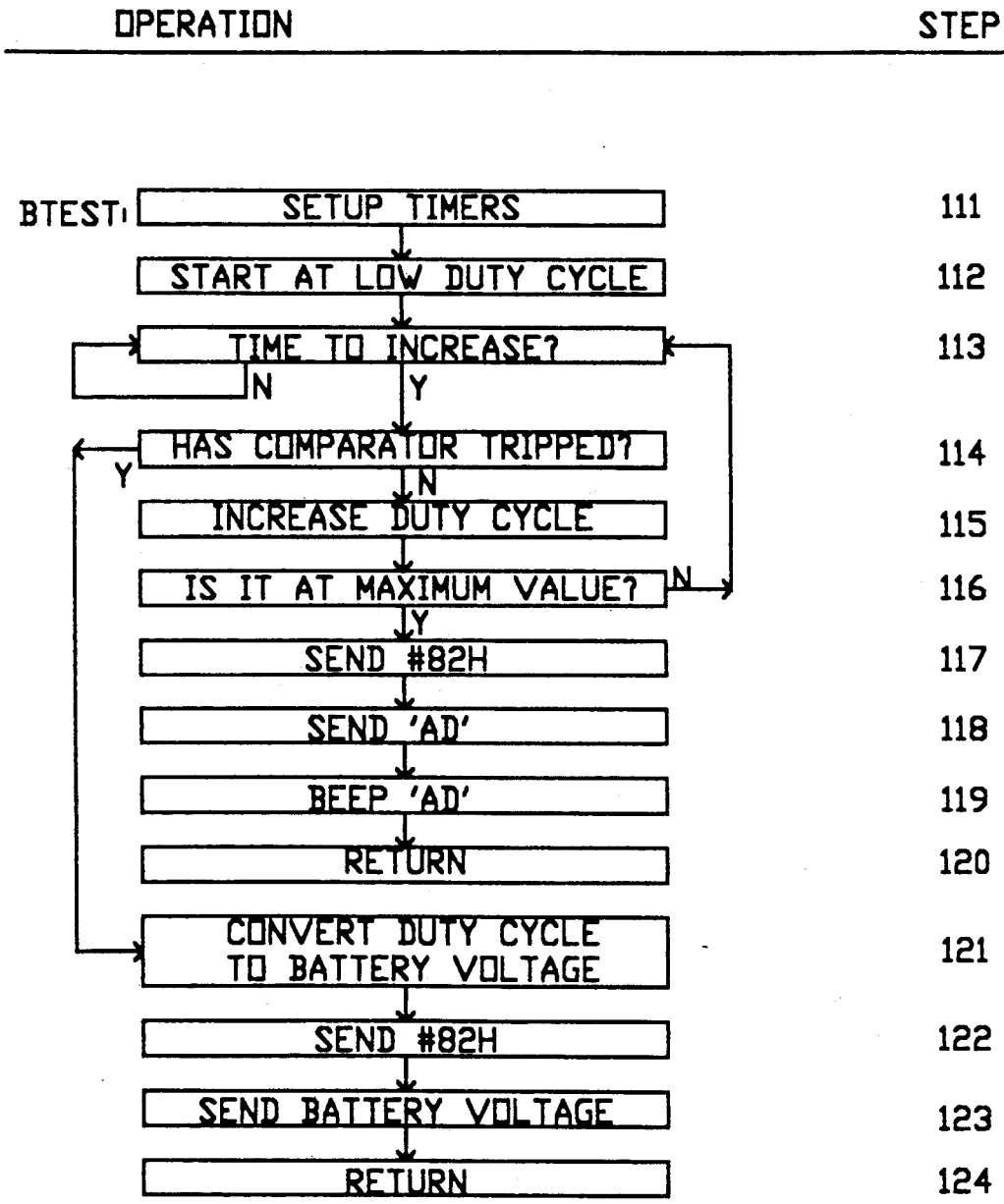
Figure 11H:
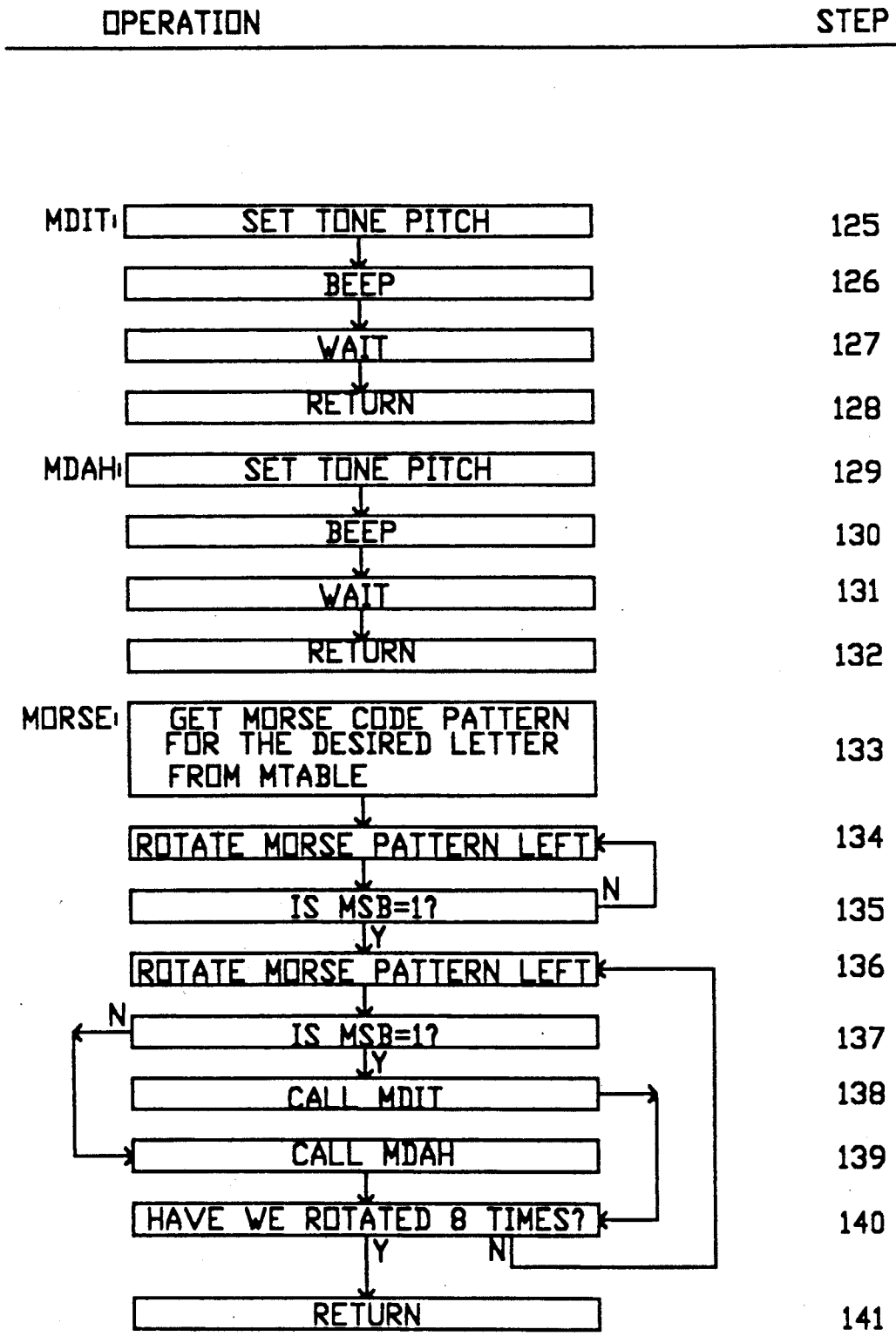
Figure 11I:
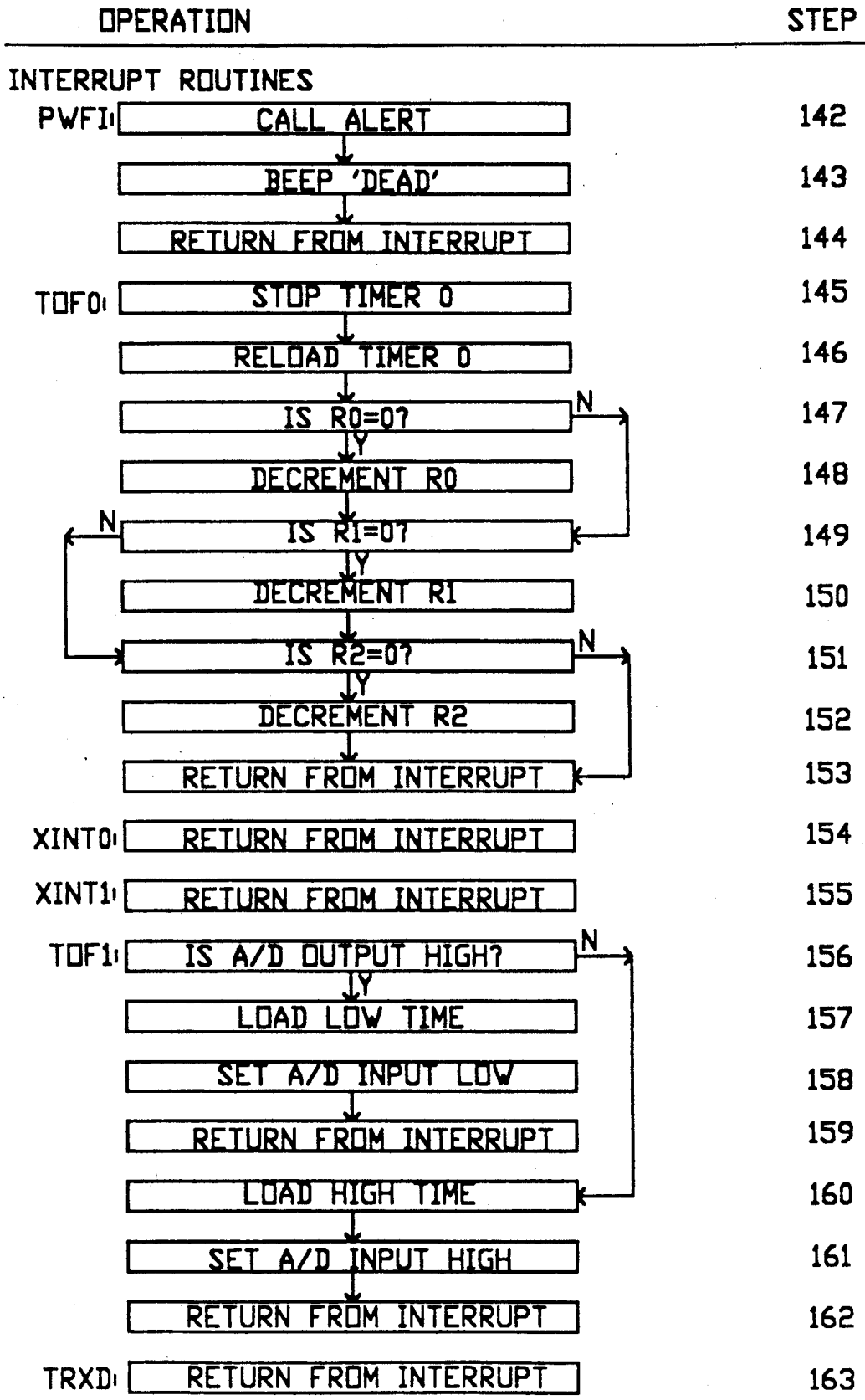
Figure 12A:
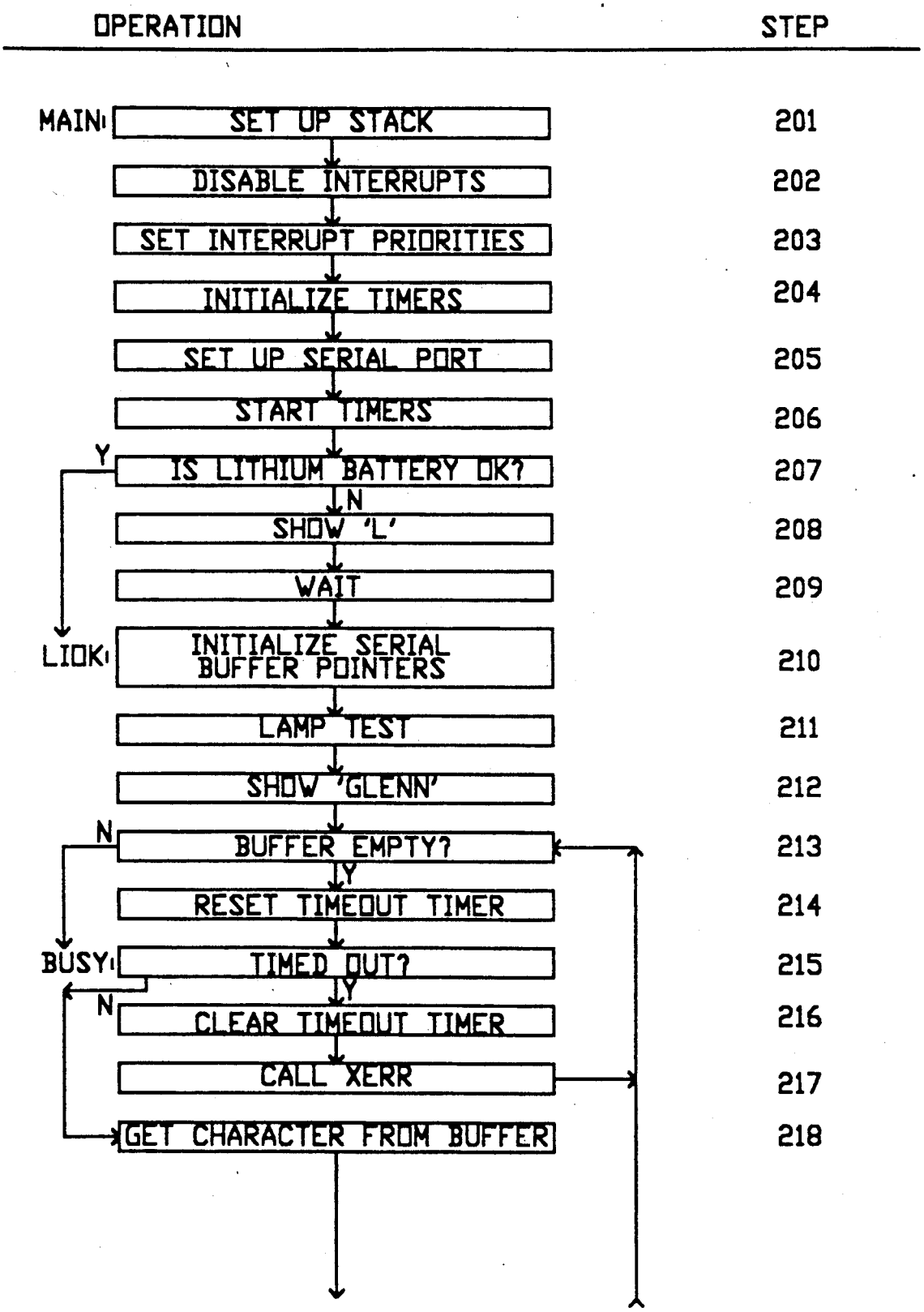
FIGS. 12A–12F represent a flow chart showing the microprocessor control of the receiving system shown in FIG. 8.
Figure 12B:
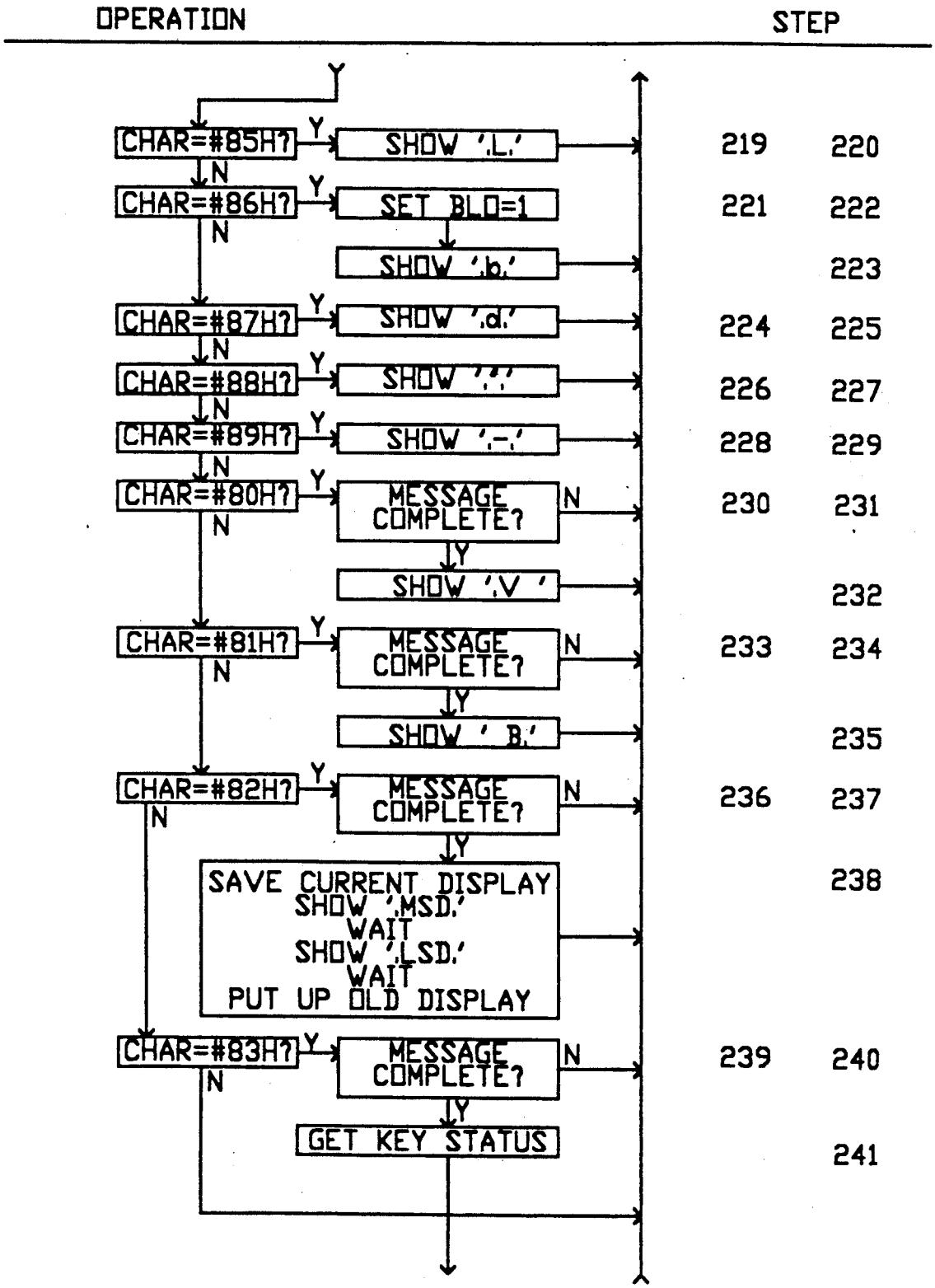
Figure 12C:
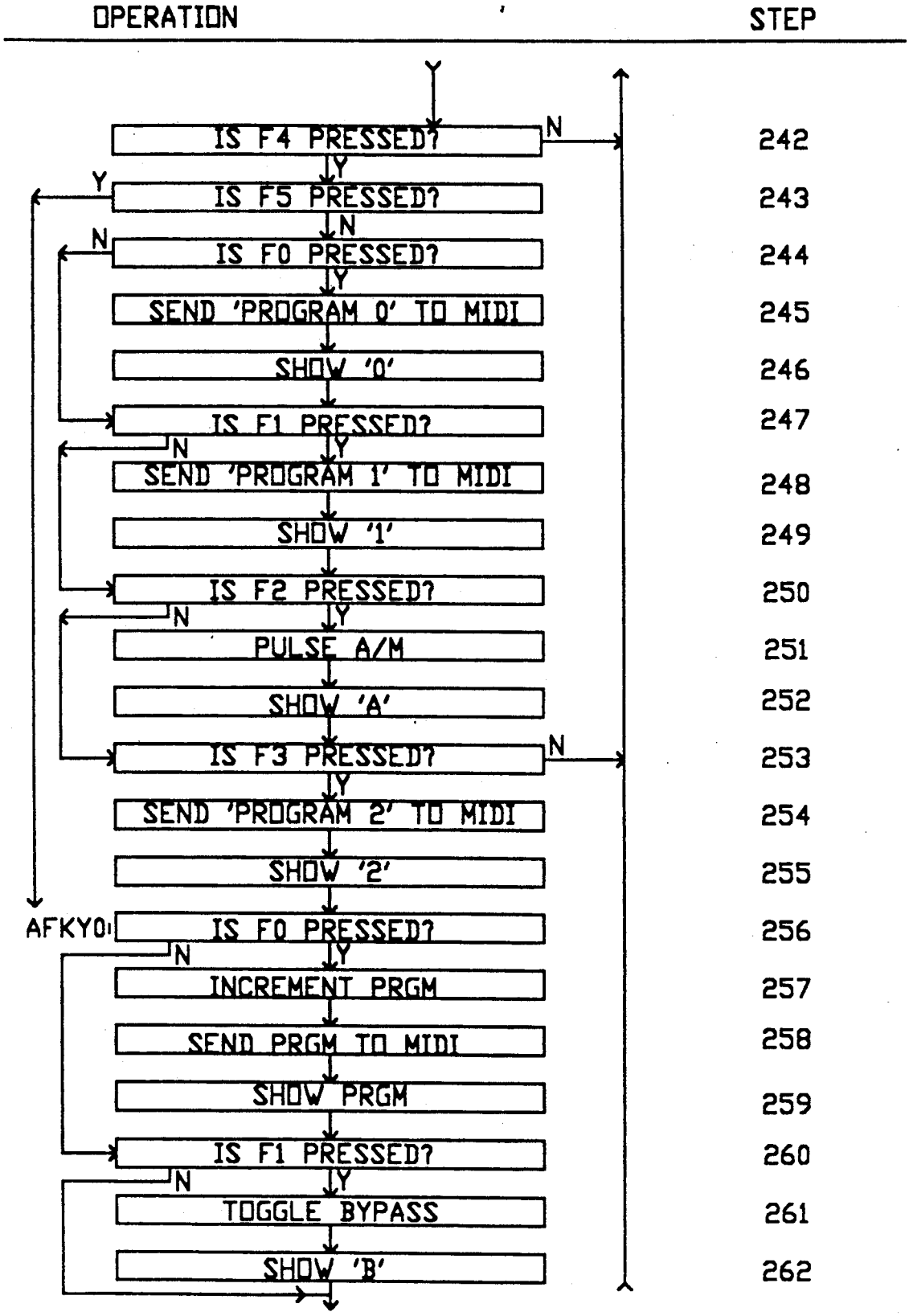
Figure 12D:
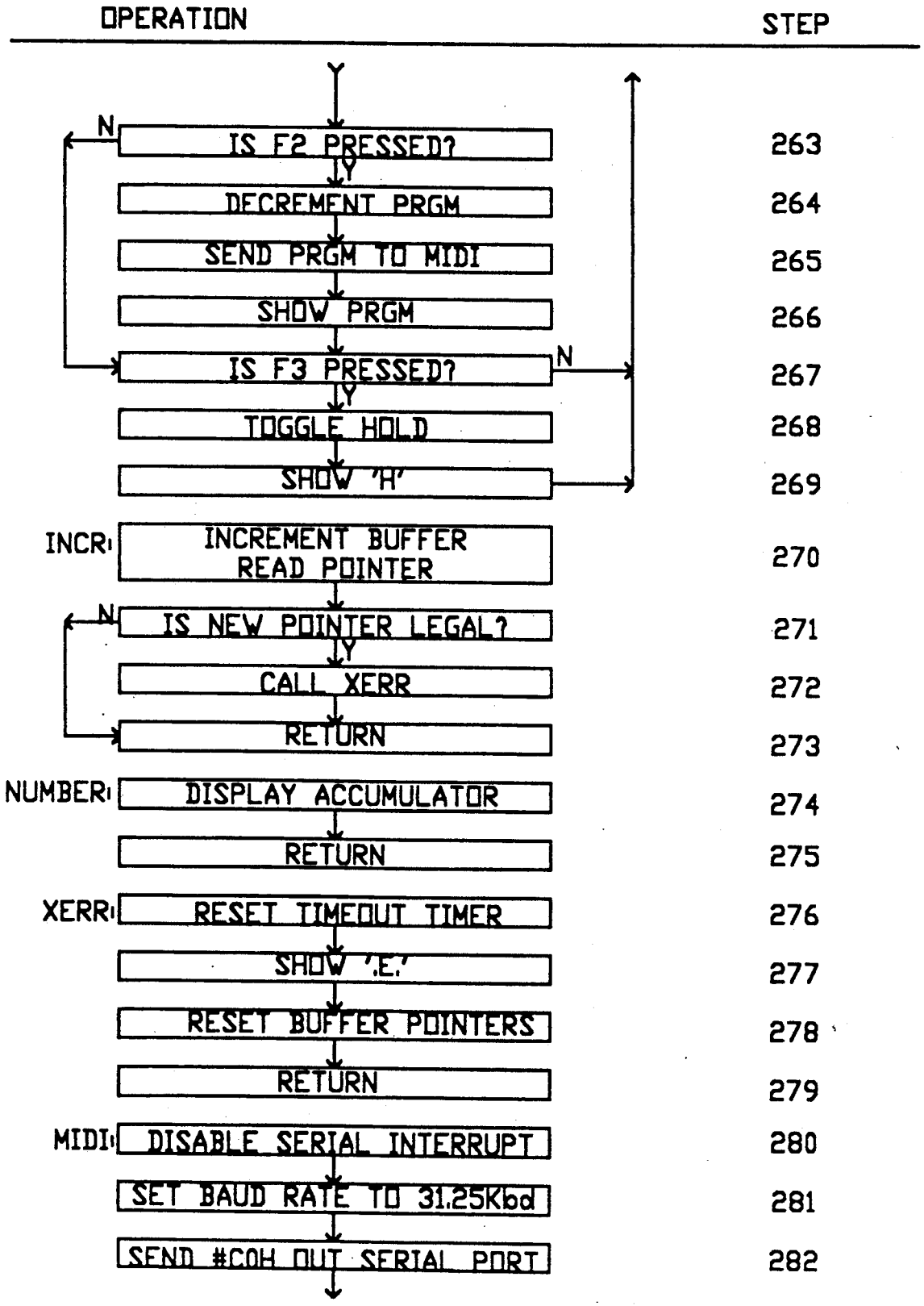
Figure 12E:
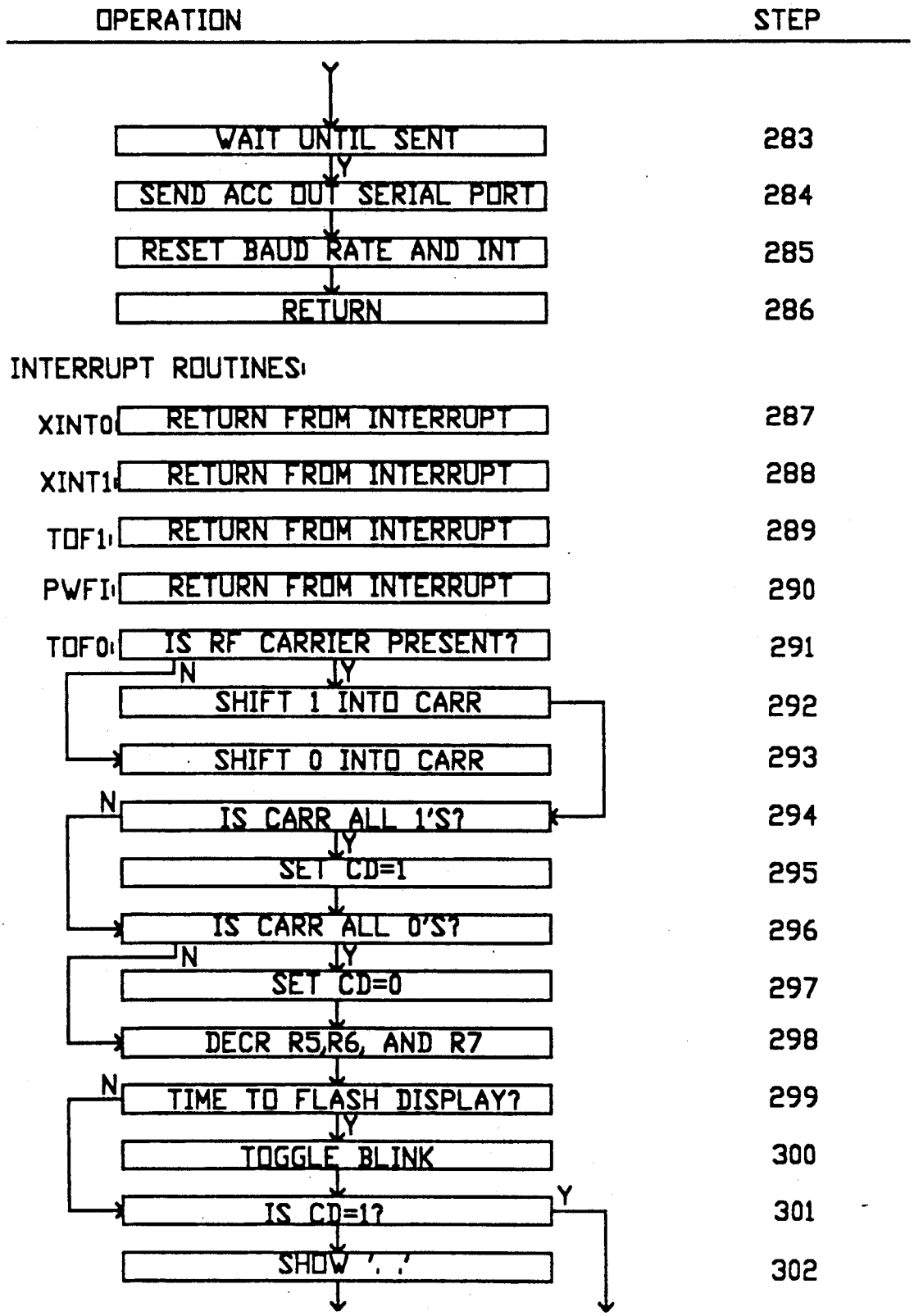
Figure 12F:
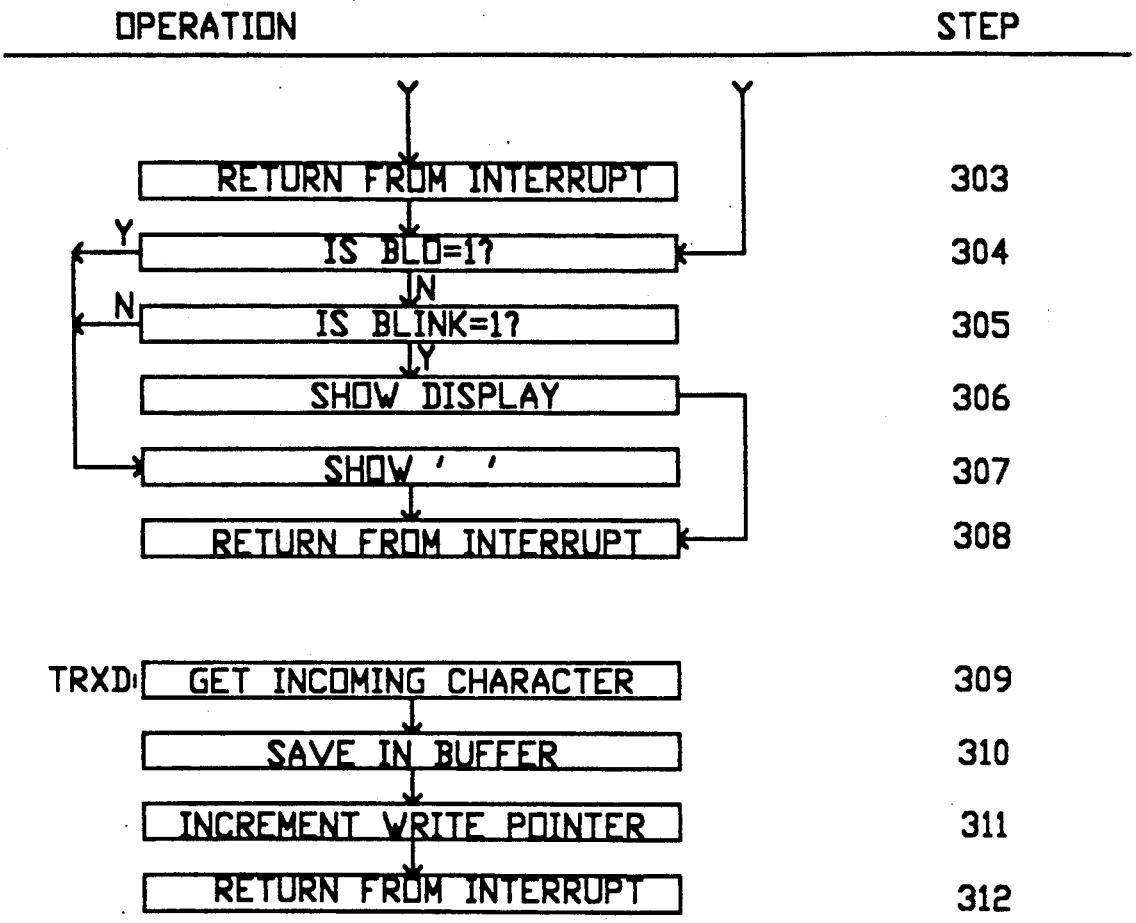

Referring now to FIGS. 8, 9 and 10, FIG. 9 shows a modification of a Yamaha type WXY-10UR receiver incorporating an ultrasonic filter 56 and detector 58 providing a binary serial output at jack J20 for connection to corresponding jack J20A of the signal processing and display controller 60 shown in FIG. 10. Those elements which must be added to the Yamaha receiver are contained within dotted outline D01 in FIG. 9.

Considering first the circuit shown in FIG. 9, 40 kilohertz ultrasonic carrier bursts are derived from the output of transistor Q304 and are passed through a low pass filter based upon integrated circuit IC400A followed by a high pass circuit based upon integrated circuit IC400B. The 40 kilohertz bursts are rectified by means of diodes CR400, CR401 to produce a corresponding binary string at the base of transistor Q400. The collector of Q400 is connected to output jack J20 to supply this binary string to the signal processing and display controller 60 shown in FIG. 8. Transistor Q304 of the receiver is a noise amplifier used to operate a squelch circuit based upon transistors Q305, Q306, the function of such a circuit being to disable the audio output in the event of carrier loss. In the event of such carrier loss, the resulting amplified white noise will be fed through the filters based upon IC400A and IC400B, the filtered white noise then being rectified by diodes CR401, CR400 to place transistor Q400 into a continuously on condition, thereby driving the output of jack J20 continuously low. The condition is used to cause a "lost carrier" symbol to be outputted to the display unit (FIG. 8).

The digital delay unit 62, here taken for representation purposes to be the Yamaha type D1500 is characterized by three control inputs. A serial data string provided jack J22 of the signal processing and display controller 60 will set the digital delay unit to one of three different reverberation options or modes, according to the nature of the last command string received. Additionally, bypass control is executed from jack J26 of the signal processing and display controller, an appropriate signal level applied here causing the digital delay unit to be bypassed completely. Additionally, a hold control is exercised via jack J24 of the signal processing and display controller 62. The "hold" mode causes an infinite number of reverberations to be produced.

The equalizer 64 is operator-settable, and may be taken for representative purposes to be the model RGE-10 frequency equalizer made by Boss, Inc.. It may be operated to a bypass condition wherein signals received are outputted directly without frequency pre-emphasis by an appropriate line condition on a bypass controlled terminal, the signal being provided by the signal processing and display controller 60 to jack J28.

Considering the signal processing and display controller 60 in conjunction with the display element 66, these two units are shown in schematic form in FIG. 10. All transistors are type 2N2222A, and all inverters are type 40106. This unit is presumed to be powered directly from ac power lines through a conventional rectifier, and thus power conservation is not at issue. Thus, a dormant microprocessor mode is not necessary, and initiation of program sequencing of microprocessor of U500 is achieved simply by application of a power-up reset condition applied to terminal 9. Serial binary commands received from jack J20A are sensed at port P3.0. Displays corresponding to received commands are outputted from ports P0.0–P0.7 and port P2.7, being relayed via drivers of the 40106 type through transistors of the 2N2222A type to actuate the various segments of the display 66. Additionally, the commands corresponding to these displays are also sent to control the digital delay unit 62 (FIG. 8) via serial output port 3.1 to jack J22. The Yamaha digital delay unit 62 is provided with a light-emitting diode as its input coupling unit. The two terminals of Jack J22 connect this diode to be serially energized.

Equalizer bypass control is achieved by the logical state of output port P2.4 as relayed to output jack J28. The digital delay unit 62 may be placed in hold or bypass mode simply by grounding output jacks J24, J26. This is accomplished by relay contactors K1', K2', actuated by relay coils K1, K2. These relay coils are actuated responsively to an appropriate signal condition placed on output ports P2.6 and P2.5 respectively to achieve these functions.

As in the case of the transmitter, the microprocessor U500 has a self-contained lithium battery used to maintain the program stored in memory.

Table III is a listing of the program to be stored in memory in the receiving system microprocessor U500 (FIG. 10). Here again, the listing shown is that prior to assembly. FIGS. 12A–12D represent a flow chart corresponding to the listing shown in Table III. FIGS. 12A–12D and Table III will be self-explanatory to those skilled in the art. As in the transmitter microprocessor, a power control register PCON monitors the status of the lithium battery. This monitoring is done once on power-up reset, and in the case of a weak lithium battery causing an appropriate flag to be set in the power control register, the display "L" is outputted to the display 66. This display is maintained until a command string is received at port P3.0, i.e., from jack J20A. The command strings received according to the protocols shown in Table II are decoded to actuate the display 66 to a corresponding signal condition, and also effecting any mode changes in the associated audio processing systems by control signals outputted from port P3.1, P2.4, P2.5, and P2.6. As previously discussed, the presence of continuous white noise received at jack J22 implies loss of carrier, this condition causing the symbol ". ." to be displayed.

Thus, there has been described a complete command and control communication system whereby operator-established settings of not only the status of the portable instrument, such as fade and volume settings, but also the current status of the remotely located receiver and audio processing equipment is immediately visible. By placing the display in the associated circuitry at the receiver installation where power is not a critical consideration a bright readily visible luminous display may be used without placing abnormal demands upon the battery power supply of the portable instrument. Additionally, it should be noted that both the volume and fader controls, using multiplying digital-to-analog converters, are not prone to mechanical failure, as contrasted with conventional potentiometer systems, which are prone to noise generation after substantial use.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

TABLE I

TRANSMITTER MICROPROCESSOR CONTROL PROGRAM

```
;These are the SFR locations in the 8051
;        B: REG   0F0H    ;00H  B Register
;        A: REG   0E0H    ;00H  Accumulator
;      PSW: REG   0D0H    ;00H  Program Status Word
;       IP: REG   0B8H    ;00H  Interrupt Priority
;       P3: REG   0B0H    ;0FFH Port 3
;       IE: REG   0A8H    ;00H  Interrupt Enable
;       P2: REG   0A0H    ;0FFH Port 2
;     SBUF: REG   099H    ;??   Serial Data Buffer
;     SCON: REG   098H    ;00H  Serial Control
;       P1: REG   090H    ;0FFH Port 1
;      TH1: REG   08DH    ;00H  Timer 1 High Byte
;      TH0: REG   08CH    ;00H  Timer 0 High Byte
;      TL1: REG   08BH    ;00H  Timer 1 Low Byte
;      TL0: REG   08AH    ;00H  Timer 0 Low Byte
```

```
;     TMOD: REG   089H    ;00H  Timer Mode Select
;     TCON: REG   088H    ;00H  Timer Control
;      DPH: REG   083H    ;00H  Data Pointer High Byte
;      DPL: REG   082H    ;00H  Data Pointer Low Byte
;       SP: REG   081H    ;07H  Stack Pointer
;       P0: REG   080H    ;0FFH Port 0

;Message Protocol:
;          #80H  volume
;          #81H  balance
;          #82H  Batt V MSD,Batt V LSD
;          #83H  keys    (for function changes)
;          #85H                          Bad Lithium Battery
;          #86H                          Low Battery (Comparator output)
;          #87H                          Dead Battery (PWR Fail Warning)

;These MACROS allow direct data moves to SFR's not
;implemented in this version of the 8051 assembler.

XMVI:      .MACRO        ARG1,ARG2       ;MOV  direct,#data
           .BYTE    075H,ARG1,ARG2       ;Moves data to direct
           .MACEND

XMAD:      .MACRO        ARG1            ;MOV  acc,direct
           .BYTE 0E5H,ARG1               ;Moves direct to A
           .MACEND

XMDA:      .MACRO        ARG1            ;MOV  direct,acc
           .BYTE 0F5H,ARG1               ;Moves A to direct
           .MACEND

;These SFR's are not implemented
;in this version of the 8051 assembler.
      TA: EQU   0C7H    ;055H Timed Access   *DS5000*
    MCON: EQU   0C6H    ;RT   Memory Control *DS5000*
    PCON: EQU   087H    ;RT   Power Control
;P0 Port 0 = Function Keys
;      F0: REG   P0.0    ;Vol Up              /   Xmtr On
;      F1: REG   P0.1    ;Bal A               /   Xmtr Off
;      F2: REG   P0.2    ;Vol Dn              /   Batt Test
;      F3: REG   P0.3    ;Bal B               /   Tune
;      F4: REG   P0.4    ;Reserved Function   /   Mute Off/On
```

```
;       F5: REG   P0.5     ;Power Function
      SW1: REG   P0.6     ;DIP Switches
      SW2: REG   P0.7

;P1 Port 1
     MUTE: REG   P1.0     ;0=Muting on
     XPWR: REG   P1.1     ;1=Transmitter Power On
     APWR: REG   P1.2     ;0=Main Power On. Inverted for stability on Poff
     BEEP: REG   P1.3     ;Output to Piezo
      PWM: REG   P1.4     ;PWM Out to Batt Comparator
     XOSC: REG   P1.5     ;0=Xmtr Oscillator on 1=Off
      AWR: REG   P1.6     ;0= Latch Data to DAC A
      BWR: REG   P1.7     ;0= Latch Data to DAC B

;P2 Port 2
     DACS: REG   P2       ;DAC Output

;P3 Port 3
      RXD: REG   P3.0
      TXD: REG   P3.1
     INT0: REG   P3.2     ;Output of Batt A/D
     INT1: REG   P3.3     ;Output of Low Batt Comp
;       T0: REG   P3.4     ;Not Used
;       T1: REG   P3.5     ;Not Used
;       WR: REG   P3.6     ;Not Used
;       RD: REG   P3.7     ;Not Used

;IE Interrupt Enable Register
      EX0: REG   IE.0     ;External Interrupt 0
      ET0: REG   IE.1     ;Timer 0 Overflow
      EX1: REG   IE.2     ;External Interrupt 1
      ET1: REG   IE.3     ;Timer 1 Overflow
       ES: REG   IE.4     ;Serial Port
;        : REG   IE.5     ;Not Used
;        : REG   IE.6     ;Not Used
       EA: REG   IE.7     ;Enable Interrupts

;IP Interrupt Priority Register
      PX0: REG   IP.0     ;External Interrupt 0
      PT0: REG   IP.1     ;Timer 0 Overflow
      PX1: REG   IP.2     ;External Interrupt 1
      PT1: REG   IP.3     ;Timer 1 Overflow
```

```
      PS: REG   IP.4    ;Serial Port
;       : REG   IP.5    ;Not Used
;       : REG   IP.6    ;Not Used
     RWT: REG   IP.7    ;Reset Watchdog Timer   *DS5000*


;TCON Timer Control Register
     IT0: REG   TCON.0  ;INT0 Falling edge/Low level 1/0
     IE0: REG   TCON.1  ;INT0 Edge Flag
     IT1: REG   TCON.2  ;INT1 Falling edge/Low level 1/0
     IE1: REG   TCON.3  ;INT1 Edge Flag
     TR0: REG   TCON.4  ;Timer 0 Run Control 1/0 Run/Stop
     TF0: REG   TCON.5  ;Timer 0 Overflow Flag
     TR1: REG   TCON.6  ;Timer 1 Run Control 1/0 Run/Stop
     TF1: REG   TCON.7  ;Timer 1 Overflow Flag

;SCON Serial Port Control Register
      RI: REG   SCON.0  ;Receive Interrupt Flag
      TI: REG   SCON.1  ;Transmit Interrupt Flag
     RB8: REG   SCON.2  ;9th Data Bit Received
     TB8: REG   SCON.3  ;9th Data Bit Transmitted
     REN: REG   SCON.4  ;Enable Serial Reception
     SM2: REG   SCON.5  ;Multiprocessor Communication Feature Enable
     SM1: REG   SCON.6  ;Serial Port Mode
     SM0: REG   SCON.7  ;Serial Port Mode

;PSW Program Status Word
;     CY: REG   PSW.0  ;Carry
;     AC: REG   PSW.1  ;Auxiliary Carry
     FL0: REG   PSW.2  ;General Purpose Flag
     RS1: REG   PSW.3  ;Register Bank Select Bit 1
     RS0: REG   PSW.4  ;Register Bank Select Bit 0
;     OV: REG   PSW.5  ;Overflow Flag
;       : REG   PSW.6  ;Not Used
;      P: REG   PSW.7  ;Parity Flag
;Keyboard Buffer
      K5: REG   21H    ;latest keystroke
      K4: REG   22H    ;
      K3: REG   23H    ;
      K2: REG   24H    ;
      K1: REG   25H    ;
      K0: REG   26H    ;earliest keystroke
```

```
K5.0: REG   21H.0   ;latest Keystroke
K5.1: REG   21H.1
K5.2: REG   21H.2
K5.3: REG   21H.3
K5.4: REG   21H.4
K5.5: REG   21H.5
K5.6: REG   21H.6
K5.7: REG   21H.7

K4.0: REG   22H.0
K4.1: REG   22H.1
K4.2: REG   22H.2
K4.3: REG   22H.3
K4.4: REG   22H.4
K4.5: REG   22H.5
K4.6: REG   22H.6
K4.7: REG   22H.7
K3.0: REG   23H.0
K3.1: REG   23H.1
K3.2: REG   23H.2
K3.3: REG   23H.3
K3.4: REG   23H.4
K3.5: REG   23H.5
K3.6: REG   23H.6
K3.7: REG   23H.7
K2.0: REG   24H.0
K2.1: REG   24H.1
K2.2: REG   24H.2
K2.3: REG   24H.3
K2.4: REG   24H.4
K2.5: REG   24H.5
K2.6: REG   24H.6
K2.7: REG   24H.7
K1.0: REG   25H.0
K1.1: REG   25H.1
K1.2: REG   25H.2
K1.3: REG   25H.3
K1.4: REG   25H.4
K1.5: REG   25H.5
K1.6: REG   25H.6
K1.7: REG   25H.7
K0.0: REG   26H.0
```

```
  K0.1: REG   26H.1
  K0.2: REG   26H.2
  K0.3: REG   26H.3
  K0.4: REG   26H.4
  K0.5: REG   26H.5
  K0.6: REG   26H.6
  K0.7: REG   26H.7

      : REG   20H.0
      : REG   20H.1
   BLO: REG   20H.2   ;1=Batt low, 0=Batt ok (for Low Batt comprtr)
   BLR: REG   20H.3   ;0 = B atten, 1 = A atten (MSbit of BALANCE)
   VUD: REG   20H.4   ;1=Move Vol Up, 0=Move Down
   BUD: REG   20H.5   ;0=Move Bal to A  1=Move Bal to B
 VFAST: REG   20H.6   ;1=Move Volume Fast
 BFAST: REG   20H.7   ;1=Move Balance Fast


  NVP1: REG   30H     ;Saved contents of P0
TFREQH: REG   31H     ;Set Tone Freq  TFREQ=65536 - Fosc  /(24*Freq)
TFREQL: REG   32H     ;Freq=Fosc / (24*(65536-TFREQ))
VOLUME: REG   33H     ;00H = MAX , 0FFH = MIN  Volume
BALANCE: REG  34H     ;BLR is MSbit of this word.
                      ;000H = A only, 0FFH=100H=Center, 1FFH=B  only
 LDACA: REG   35H     ;Current DAC A Setting
 LDACB: REG   36H     ;Current DAC B Setting
   LVS: REG   37H     ;Last volume sent (4 MSB's only)
   LBS: REG   38H     ;Last balance sent (4 MSB's only)
 .CODE

 .ORG  00H
          JMP   MAIN
 .ORG  03H
          JMP   XINT0
 .ORG  0BH
          JMP   TOF0
 .ORG  13H
          JMP   XINT1
 .ORG  1BH
          JMP   TOF1
 .ORG  23H
```

```
        JMP   TRXD
.ORG  2BH
        JMP   PFWI                          ;Power Fail Interrupt


.ORG  30H    ;THIS MUST STAY HERE*** (see MORSE)
;Morse Code Lookup Table.  From left to right, first "1" is
;start bit, then  "0"=dit, "1"=dah.
 MTABLE: .BYTE 00111111B                    ;0   0
         .BYTE 00101111B                    ;1   1
         .BYTE 00100111B                    ;2   2
         .BYTE 00100011B                    ;3   3
         .BYTE 00100001B                    ;4   4
         .BYTE 00100000B                    ;5   5
         .BYTE 00110000B                    ;6   6
         .BYTE 00111000B                    ;7   7
         .BYTE 00111100B                    ;8   8
         .BYTE 00111110B                    ;9   9
         .BYTE 00000000B                    ;:   A
         .BYTE 00000000B                    ;;   B
         .BYTE 00000000B                    ;_   C
         .BYTE 00000000B                    ;=   D
         .BYTE 00000000B                    ;¢   E
         .BYTE 00000000B                    ;?   F
         .BYTE 00000000B                    ;@  10
         .BYTE 00000101B                    ;A  11
         .BYTE 00011000B                    ;B  12
         .BYTE 00011010B                    ;C  13
         .BYTE 00001100B                    ;D  14
         .BYTE 00000010B                    ;E  15
         .BYTE 00010010B                    ;F  16
         .BYTE 00001110B                    ;G  17
         .BYTE 00010000B                    ;H  18
         .BYTE 00000100B                    ;I  19
         .BYTE 00010111B                    ;J  1A
         .BYTE 00001101B                    ;K  1B
         .BYTE 00010100B                    ;L  1C
         .BYTE 00000111B                    ;M  1D
         .BYTE 00000110B                    ;N  1E
         .BYTE 00001111B                    ;O  1F
         .BYTE 00010110B                    ;P  20
         .BYTE 00011101B                    ;Q  21
         .BYTE 00001010B                    ;R  22
```

```
        .BYTE 00001000B          ;S  23
        .BYTE 00000011B          ;T  24
        .BYTE 00001001B          ;U  25
        .BYTE 00010001B          ;V  26
        .BYTE 00001011B          ;W  27
        .BYTE 00011001B          ;X  28
        .BYTE 00011011B          ;Y  29
        .BYTE 00011100B          ;Z  2A

MAIN:   MOV   SP,#60H            ;Stack at 60H (32 Bytes)
        MOV   P1,NVP1            ;Restore Port 1
        MOV   DACS,LDACA         ;Restore DAC settings from
        CLR   AWR                ;last gig
        SETB  AWR
        MOV   DACS,LDACB
        CLR   BWR
        SETB  BWR
        MOV   IE,#00H            ;Disable all interrupts
        SETB  PT0                ;Set Timer 0 INT = high priority
        CLR   IT0                ;Set Batt A/D to be level triggered.
        CLR   IT1                ;Set Lo Batt to be level triggered.
        MOV   TMOD,#01H          ;Set up Timer 0 to  generate
        CLR   TR0                ;real time clock.
        CLR   TF0                ;CLR R/S and OF flags
        SETB  ET0                ;Enable Timer 0 Interrupt
        SETB  EA                 ;Enable Interrupts
        SETB  TR0                ;Start Timer 0
        XMAD  PCON               ;See if we had a no Vli  reset
        MOV   R0,A               ;Save PCON in R0
        XMAD  MCON               ;
        XMVI  TA,0AAH            ;Timed Access Register
        XMVI  TA,055H            ;
        XMVI  PCON,01001000B     ;Enable EPFW,Disable EWT
        XRL   A,#11111010B       ;If MCON=11111010 and  PCON=0,
        ADD   A,R0               ;we have a bad lithium  battery
        JNZ   LIOK
        CALL  ALERT
        MOV   A,#85H             ;Send Code for Bad Lithium Battery
        CALL  SEND
        MOV   A,#1CH             ;Send 'LI'
        CALL  MORSE
        MOV   A,#19H
```

```
        CALL  MORSE
        MOV   DACS,#00H          ;Set Both DACS to max  volume
        CLR   AWR                ;Strobe DAC A
        SETB  AWR
        CLR   BWR                ;Strobe DAC B
        SETB  BWR
        MOV   A,#20              ;Wait until analog settles
        CALL  DELAY
        SETB  MUTE               ;Un-mute it
        MOV   NVP1,#11111111B    ;This is the state for P1 on
                                 cold reset
        XMVI  TA,0AAH            ;Timed Access Register
        XMVI  TA,055H            ;
        ORL   IP,#80H            ;
        XMVI  PCON,42H           ;Go to Sleep
SLEEP1: JMP   SLEEP1
  LIOK: MOV   A,R0               ;Put PCON in A
        ANL   A,#01000000B       ;See if we had a Power On Reset
        JNZ   WARM               ;
        CLR   MUTE               ;Its Cold, Mute it.
        SETB  APWR               ;Keep off APWR
        CLR   XPWR               ;Keep off XPWR
        SETB  XOSC               ;Keep off oscillator
        MOV   NVP1,#11111111B    ;This is the state for P1
;                                 on cold reset
        MOV   A,#40              ;Wait 2 seconds
        CALL  DELAY
        CLR   APWR               ;then turn on APWR
        SETB  XPWR               ;Prepare to send message
        MOV   A,20
        CALL  DELAY
        CLR   XOSC               ;Transmitter on
        MOV   A,#17H             ;Send 'Glenn'
        CALL  MORSE
        MOV   A,#1CH
        CALL  MORSE
        MOV   A,#15H
        CALL  MORSE
        MOV   A,#1EH
        CALL  MORSE
        MOV   A,#1EH
        CALL  MORSE
```

```
      CLR   BLO                 ;Assume Battery is OK
      MOV   TFREQH,#0FFH        ;Set Tone freq to **** Hz
      MOV   TFREQL,#90H         ;TFREQ=
      MOV   A,#88H              ;Bass PWR Up
      CALL  SEND
      MOV   C,INT1              ;See if Batt Low
      JC    OKB
      MOV   A,#86H              ;Send Power up code
      CALL  SEND
OKB:  SETB  XOSC
      MOV   A,20
      CALL  DELAY
      CLR   XPWR
      SETB  MUTE                ;Un-mute it
WARM: MOV   C,INT1              ;See if Batt Low
      ORL   C,BLO               ;Do we already know?  (1=yes)
      JC    BTOK
      CALL  ALERT               ;Low Battery
      MOV   A,#86H
      CALL  SEND
      MOV   A,#1CH
      CALL  MORSE               ;Send 'LOW'
      MOV   A,#1FH
      CALL  MORSE
      MOV   A,#27H
      CALL  MORSE
      SETB  BLO                 ;We know its low
BTOK: CALL  KEYCHK              ;Read the Buttons
      MOV   NVP1,P1
      MOV   IE,#00H             ;Disable all interrupts
      MOV   LVS,#00H            ;Vol and Bal sent when you touch
      MOV   LBS,#00H            ;the keys.
      XMVI  TA,0AAH             ;Timed Access Register *DS5000*
      XMVI  TA,055H             ;                      *DS5000*
      XMVI  PCON,42H            ;Go to Sleep
SLEEP2: JMP SLEEP2              ;Guard

KEYCHK: PUSH  PSW               ;Keyboard Input Routine
      SETB  RS0                 ;Switch to bank 1 to read clock
      CLR   RS1
      MOV   K5,#00H
      MOV   K4,#00H             ;Clear key buffer
```

```
        MOV   K3,#00H
        MOV   K2,#00H
        MOV   K1,#00H
        MOV   K0,#00H
KLP1:   MOV   A,P0              ;Read Keys
        ANL   A,#3FH            ;Mask out DIP switches
        JNZ   KBUSY             ;A key is pressed
        POP   PSW               ;Restore REG Bank 0
        RET                     ;RETURN****
KBUSY:  MOV   A,P0              ;Reread Keys
        CJNE  A,K5,KNEW         ;K=K5?
        MOV   C,K5.5            ;See if Power or Reserved keys
        ORL   C,K5.4            ;still held
        JC    KLP1              ;Yes. Don't go thru routine again
        JMP   KAGN              ;Yes, same keys still held.
KNEW:   PUSH  A                 ;A new key is pressed
        MOV   A,#01H
        CALL  TONE              ;Beep
        POP   A
        MOV   K0,K1             ;Push the new key setting onto stack
        MOV   K1,K2
        MOV   K2,K3
        MOV   K3,K4
        MOV   K4,K5
        MOV   K5,A
KAGN:   MOV   C,K5.5            ;See if Power or Reserved keys pushed
        ORL   C,K5.4
        JNC   KVCK              ;Nope, neither
        MOV   C,K5.5            ;See if both pressed
        ANL   C,K5.4            ;Yes, see which one pressed first
        MOV   A,K5
        JNC   KRCK
        MOV   C,K4.5
        ANL   C,K4.4
        MOV   A,K4
        JNC   KRCK
        MOV   C,K3.5
        ANL   C,K3.4
        MOV   A,K3
        JNC   KRCK
        MOV   C,K2.5
        ANL   C,K2.4
```

```
        MOV   A,K2
        JNC   KRCK
        MOV   C,K1.5
        ANL   C,K1.4
        MOV   A,K1
        JNC   KRCK
        MOV   C,K0.5
        ANL   C,K0.4
        MOV   A,K0
        JNC   KRCK
KRCK:   JNB   A.4,KPCK        ;Reserved function = F4
        JMP   RESFCN
KPCK:   JNB   A.5,KVCK        ;Power function = F5
        JMP   POWFCN
KVCK:   MOV   C,K5.0          ;VOLUME
        ORL   C,K5.2          ;Is either key pressed?
        JNC   KBAL            ;No,jump to do balance.
        MOV   C,K5.0          ;Yes, are F0 and F2 pressed?
        MOV   VUD,C           ;
        ANL   C,K5.2          ;
        MOV   VFAST,C         ;If so, set FAST
        JNC   KVOL1           ;No, jump to move slowly
        MOV   C,K4.0          ;Yes, look back in table
        MOV   VUD,C           ;to see which was pressed first.
        ANL   C,K4.2          ;
        JNC   KVOL1
        MOV   C,K3.0
        MOV   VUD,C           ;
        ANL   C,K3.2
        JNC   KVOL1
        MOV   C,K2.0
        MOV   VUD,C           ;
        ANL   C,K2.2
        JNC   KVOL1
        MOV   C,K1.0
        MOV   VUD,C           ;
        ANL   C,K1.2
        JNC   KVOL1
        MOV   C,K0.0
        MOV   VUD,C           ;
        ANL   C,K0.2
        JC    KBAL            ;Can't tell, forget it and do balance
```

```
KVOL1: MOV   A,R0            ;R0 is Volume Timer. VUD,VFAST valid.
       JNZ   KBAL            ;Not time to do anything yet.
       MOV   R0,#01H         ;Its time, reset clock
       MOV   A,#01H          ;Slow - set increment
       JNB   VFAST,KVUD      ;Fast or Slow?
       MOV   A,#04H          ;Fast - set increment
KVUD:  JNB   VUD,KVDN        ;Up or Down?
       CPL   A               ;Volume up = decrease  VOLUME
       INC   A               ;2's compl increment and add
       CLR   C
       ADD   A,VOLUME
       JC    KVSAV           ;If no carry, underflow
       CLR   A
       PUSH  A
       MOV   A,#01H
       CALL  TONE            ;Beep
       POP   A
       JMP   KVSAV
KVDN:  CLR   C               ;Volume down = increase VOLUME
       ADD   A,VOLUME
       JNC   KVSAV
       MOV   A,#0FFH         ;If carry, overflow
       PUSH  A
       MOV   A,#01H
       CALL  TONE            ;Beep
       POP   A
KVSAV: MOV   VOLUME,A        ;Save new VOLUME
       CPL   A               ;See if 4 MSB's of VOLUME changed
       ANL   A,#0F0H         ;make 0=max
       SWAP  A
       CJNE  A,LVS,KSENDV    ;Compare it to last volume sent
       JMP   KBAL
KSENDV: MOV  LVS,A           ;Save changed volume
       MOV   A,#80H          ;Code for volume
       CALL  SEND
       MOV   A,LVS
       CALL  SEND
KBAL:  MOV   C,K5.1          ;BALANCE
       ORL   C,K5.3          ;Is either key pressed?
       JC    KDOBAL          ;Jump to KDACUP is too  long.
       JMP   KDACUP          ;No,jump to calculate DACS
KDOBAL: MOV  C,K5.3          ;Yes, are F1 and F3  pressed?
```

```
        MOV   BUD,C              ;
        ANL   C,K5.1             ;
        MOV   BFAST,C            ;If so, set FAST
        JNC   KBAL1              ;No, jump to move slowly
        MOV   C,K4.3             ;Yes, look back in table
        MOV   BUD,C              ;to see which was pressed first.
        ANL   C,K4.1             ;
        JNC   KBAL1
        MOV   C,K3.3
        MOV   BUD,C              ;
        ANL   C,K3.1
        JNC   KBAL1
        MOV   C,K2.3
        MOV   BUD,C              ;
        ANL   C,K2.1
        JNC   KBAL1
        MOV   C,K1.3
        MOV   BUD,C              ;
        ANL   C,K1.1
        JNC   KBAL1
        MOV   C,K0.3
        MOV   BUD,C              ;
        ANL   C,K0.1
        JC    KDACUP             ;Can't tell, forget it  update DACs.
KBAL1:  MOV   A,R1               ;R1 is Balance Timer.  BUD,BFAST vali
        JNZ   KDACUP             ;Not time to do anything yet.
        MOV   R1,#01H            ;Its time, reset clock
        MOV   A,#01H             ;Slow - set increment
        JNB   BFAST,KBUD         ;Fast or Slow?
        MOV   A,#08H             ;Fast - set increment
KBUD:   JB    BUD,KB2B           ;Balance to A or B?
        CPL   A                  ;Balance to A (BUD=0)
        INC   A
        CLR   C
        ADD   A,BALANCE
        JC    KBSAV
        JNB   BLR,KUF            ;BLR already 0, Underflow
        CLR   BLR
        PUSH  A
        MOV   A,#01H
        CALL  TONE               ;Beep as we cross center
        POP   A
        JMP   KBSAV
```

```
KUF:    CLR   A                  ;Balance all the way to A
        PUSH  A
        MOV   A,#01H
        CALL  TONE               ;Beep
        POP   A
        JMP   KBSAV
KB2B:   CLR   C                  ;Balance to B (BUD=1)
        ADD   A,BALANCE
        JNC   KBSAV
        JB    BLR,KOF            ;BLR already 1, Overflow
        SETB  BLR
        PUSH  A
        MOV   A,#01H
        CALL  TONE               ;Beep as we cross center
        POP   A
        JMP   KBSAV
KOF:    MOV   A,#0FFH            ;Balance all the way to B
        PUSH  A
        MOV   A,#01H
        CALL  TONE               ;Beep
        POP   A
KBSAV:  MOV   BALANCE,A          ;Save new BALANCE
KCB:    MOV   C,BLR              ;See if 4 MSB's of BALANCE changed
        RRC   A                  ;BLR is MSB of balance
        ANL   A,#0F0H            ;if so, send it
        SWAP  A
        CJNE  A,LBS,KSENDB       ;Compare it to last balance sent
        JMP   KDACUP             ;4 MSB's of BALANCE didn't change
KSENDB: MOV   LBS,A              ;Save changed balance
        MOV   A,#81H             ;Code for balance
        CALL  SEND
        MOV   A,LBS
        CALL  SEND
KDACUP: JB    BLR,KBL1
        MOV   R5,VOLUME          ;BLR=0, so LDACA=VOLUME
        MOV   A,BALANCE          ;LDACB=VOLUME +  .NOT.BALANCE
        CPL   A
        CLR   C
        ADD   A,VOLUME
        JNC   KOK1
        MOV   R6,#0FFH
        JMP   KDACMP
```

```
KOK1:   MOV   R6,A
        JMP   KDACMP              ;DAC A in R5, DAC B in R6
KBL1:   MOV   R6,VOLUME           ;BLR=1, so  LDACA=VOLUME+BALANCE
        MOV   A,BALANCE           ;LDACB=VOLUME
        CLR   C
        ADD   A,VOLUME
        JNC   KOK2
        MOV   R5,#0FFH
        JMP   KDACMP
KOK2:   MOV   R5,A
KDACMP: MOV   A,R5                ;DAC A in R5, DAC B in R6
        CJNE  A,LDACA,KUPA        ;is new DAC A = old value?
        JMP   KCHKB
KUPA:   MOV   LDACA,R5            ;Update LDACA
        MOV   DACS,LDACA          ;Put it out to port
        CLR   AWR                 ;Strobe DAC A
        SETB  AWR
KCHKB:  MOV   A,R6
        CJNE  A,LDACB,KUPB        ;is new DAC B = old value?
        JMP   KLP1
KUPB:   MOV   LDACB,R6            ;Update LDACB
        MOV   DACS,LDACB          ;Put it out to port
        CLR   BWR                 ;Strobe DAC B
        SETB  BWR
        JMP   KLP1
RESFCN: MOV   A,P0                ;Reserved functions go here
        ANL   A,#0FH              ;Make sure F0+F1+F2+F3 pressed
        JZ    ONEKY               ;before sending keys
        MOV   A,#83H
        CALL  SEND                ;Send key status
        MOV   A,P0
        CALL  SEND
ONEKY:  JMP   KLP1
POWFCN: JNB   K5.0,PCK1           ;F0=
        SETB  XPWR                ;Turn on Xmtr
        MOV   A,20
        CALL  DELAY
        CLR   XOSC
PCK1:   JNB   K5.1,PCK2           ;F1=
        SETB  XOSC                ;Turn off Xmtr
        MOV   A,20
        CALL  DELAY
        CLR   XPWR
```

```
PCK2: JNB   K5.2,PCK3          ;F2=
      CALL  BTEST              ;Battery Test
PCK3: JNB   K5.3,PCK4          ;F3=Power Off
      MOV   A,#40              ;Wait for 2 Seconds
      CALL  DELAY
      MOV   C,P0.5             ;See if they're still pressed
      ANL   C,P0.3
      JNC   PCK5               ;Nope, abort Power Down
      CLR   MUTE               ;Mute it
      MOV   A,#12H             ;Off Command, say 'BYE'
      CALL  MORSE
      MOV   A,#29H
      CALL  MORSE
      MOV   A,#15H
      CALL  MORSE
      MOV   A,#89H             ;Bass PWR Down
      CALL  SEND
      SETB  XOSC
      MOV   A,20
      CALL  DELAY
      CLR   XPWR
      MOV   NVP1,#11111111B    ;This is the state for P1
                                          on cold reset
      SETB  APWR               ;Shut off power
PDIE: JMP   PDIE               ;Die here
PCK4: JNB   K5.4,PCK5          ;F4=
      CPL   MUTE               ;Toggle MUTE
PCK5: JMP   KLP1

SEND: MOV   C,XPWR             ;Send A at 1200 Baud
      JNC   DSND               ;Don't send if xmtr not on
      PUSH  PSW
      PUSH  A
      CLR   TR1                ;Stop Timer 1
      ORL   TMOD,#20H          ;Set Timer 1 to mode 2 (Auto-reload)
      MOV   TH1,#0EFH          ;1.2K Baud @ 8Mhz Fck
      SETB  TR1                ;Start timer
      MOV   SCON,#50H          ;Set Serial Port Control Register
      CLR   TI                 ;CLR Xmit Interrupt Flag
      MOV   SBUF,A             ;Send word
SWT1: JNB   TI,SWT1            ;Wait until set
      CLR   TI                 ;CLR Xmit Interrupt Flag
```

```
        CLR   TR1              ;Stop timer
        ANL   TMOD,#0FH        ;Reset Mode
        CLR   TF1              ;Clear OF flag
        POP   A
        POP   PSW
DSND:   RET

DELAY:  PUSH  PSW              ;Delay for A/20 Seconds.
        PUSH  A                ;Save arg
        SETB  RS0              ;Switch to Bank 1 to read clock.
        CLR   RS1
        MOV   R2,A             ;Put time in R2.
DWAIT:  MOV   A,R2             ;Sit here until R2 becomes 0
        JNZ   DWAIT            ;(The TF0 Routine is keeping time)
        POP   A
        POP   PSW
        RET

TONE:   PUSH  PSW              ;Beep for A/20 Seconds
        PUSH  A
        CLR   TR1              ;Stop Timer 1
        ORL   TMOD,#10H        ;Set Timer 1 to mode 1. (16 bits)
        MOV   TH1,TFREQH       ;Load Tone Freq in Timer 1
        MOV   TL1,TFREQL       ;
        SETB  RS0              ;Switch to Bank 1 to read clock.
        CLR   RS1
        MOV   R2,A             ;Put time in R2.
        SETB  TR1              ;Start the oscillator
TEMT:   MOV   A,R2             ;Emit tone until R2 becomes 0
        JZ    TDUN
        JNB   TF1,TEMT         ;Timer 1 overflow?
        CLR   TR1              ;Yes, stop Timer 1
        CLR   TF1              ;Clear overflow flag.
        MOV   TH1,TFREQH       ;Reload Tone Freq in Timer 1
        MOV   TL1,TFREQL       ;
        SETB  TR1              ;Restart Timer 1
        CPL   BEEP             ;Toggle Piezo output
        JMP   TEMT             ;Keep up until time runs out.
TDUN:   SETB  BEEP             ;Set high to keep power low
        CLR   TR1              ;Stop Timer 1
        ANL   TMOD,#0FH        ;Reset Timer 1
        POP   A
        POP   PSW
        RET
```

```
ALERT: PUSH  PSW              ;Warble tone for 5 Seconds
       PUSH  A
       CLR   TR1              ;Stop Timer 1
       ORL   TMOD,#10H        ;Set Timer 1 to mode 1. (16 bits)
       MOV   TH1,TFREQH       ;Load Tone Freq in Timer 1
       MOV   TL1,TFREQL       ;
       SETB  RS0              ;Switch to Bank 1 to read clock.
       CLR   RS1
       MOV   R2,#64H          ;Put time in R2. (5 Sec)
       SETB  TR1              ;Start the oscillator
AEMT:  MOV   A,R2             ;Emit tone until R2 becomes 0
       JZ    ADN
       JNB   TF1,AEMT         ;Timer 1 overflow?
       CLR   TR1              ;Yes, stop Timer 1
       CLR   TF1              ;Clear overflow flag.
       ANL   A,#0FH           ;4 LSB's of R2 modulate TFREQL
       ADD   A,TFREQL
       MOV   TL1,A
       MOV   TH1,TFREQH
       SETB  TR1              ;Restart Timer 1
       CPL   BEEP             ;Toggle Piezo output
       JMP   AEMT             ;Keep up until time runs out.
ADN:   SETB  BEEP             ;Set high to keep power low
       CLR   TR1              ;Stop Timer 1
       ANL   TMOD,#0FH        ;Reset Timer 1
       POP   A
       POP   PSW
       RET

BTEST: PUSH  PSW              ;Battery A/D Routine
       PUSH  A
       PUSH  B
       CLR   ET0              ;Disable Timer 0
       CLR   TR1              ;Stop Timer 1
       CLR   RS0
       CLR   RS1
       ORL   TMOD,#20H        ;Set Timer 1 to Mode 1.
       MOV   R7,#07FH         ;R7 = time on.(01H is long time)
       MOV   TH1,R7           ;Load time high = R7
       MOV   A,R7
       CPL   A                ;Calculate time low = 256 - R7 = -R7
       INC   A
       MOV   R6,A             ;R6 = time off.
```

```
        SETB  ET1              ;Enable Timer 1 interrupt.
        SETB  TR1              ;Start the timer.
        MOV   R3,#04H          ;Sit at this duty for this # of cycle
        MOV   R2,#0FFH         ;R3,R2=MSB,LSB of # of cycles to sit
CYCLE:  JNB   FL0,CYCLE        ;Wait for interrupt to occur
        CLR   FL0
        DJNZ  R2,CYCLE         ;See if its time to change duty cycle
        DJNZ  R3,CYCLE         ;Check MSB of # of cycles
        MOV   R3,#03H          ;Sit at this duty for this # of cycle
        MOV   R2,#00H          ;R3,R2=MSB,LSB of # of cycles to sit
        JNB   INT0,BTRIP       ;A/D went low, we have answer in R7.
        MOV   A,R7             ;Decrement Duty Cycle
        CPL   A                ;Calculate time low = 256 - R7 = -R7
        MOV   R6,A             ;R6 = time off.
        CLR   C                ;
        MOV   A,R7             ;
        SUBB  A,#01H           ;Duty Cycle decrement value
        MOV   R7,A             ;Update R7
        JNC   CYCLE
        CLR   ET1              ;Disable Timer OF interrupt
        CLR   TR1              ;Stop timer
        ANL   TMOD,#0FH        ;Reset Mode
        CLR   TF1              ;Clear OF flag
        SETB  PWM              ;Restore D/A output
        SETB  ET0              ;Enable Timer 0 Interrupt
        POP   B
        POP   A
        POP   PSW
        CALL  ALERT            ;No trip, A/D malfunction
        MOV   A,#82H           ;Code for Batt V
        CALL  SEND
        MOV   A,#0AH           ;Send 'AD' to amp
        CALL  SEND
        MOV   A,#0DH
        CALL  SEND
        MOV   A,#11H           ;Say 'A D'
        CALL  MORSE
        MOV   A,#14H
        CALL  MORSE
        RET
BTRIP:  CLR   ET1              ;Disable Timer OF interrupt
        CLR   TR1              ;Stop timer
```

```
        CLR   FL0                ;Clear FL0
        ANL   TMOD,#0FH          ;Reset Mode
        CLR   TF1                ;Clear OF flag
        SETB  PWM                ;Restore D/A output
        MOV   A,R7               ;R7=00H = V=10V
        CPL   A                  ;A=0FFH = V=10V
        MOV   B,#100             ;DO R7*100/256
        MUL   AB                 ;V*100 in B
        MOV   A,B                ;V*100/256 now in A
        MOV   B,#10              ;Binary to BCD
        DIV   AB                 ;MSD in A, LSD in B
        PUSH  A
        SETB  ET0                ;Enable Timer 0 Interrupt
        MOV   A,#82H             ;Code for Batt V
        CALL  SEND
        POP   A
        PUSH  A
        CALL  SEND
        MOV   A,B
        CALL  SEND
        POP   A
        CALL  MORSE              ;
        MOV   A,B                ;LSD in A
        CALL  MORSE
        POP   B
        POP   A
        POP   PSW
        RET

MDIT:   PUSH  TFREQH             ;Produces a dit
        PUSH  TFREQL             ;
        PUSH  PSW
        PUSH  A
        MOV   TFREQH,#0FEH       ;New freq for morse code
        MOV   TFREQL,#5FH        ;800Hz (TFREQ=65119)
        MOV   A,#01H             ;Dit length
        CALL  TONE               ;
        MOV   A,#01H             ;Inter dit-dah spacing
        CALL  DELAY              ;
        POP   A
        POP   PSW
        POP   TFREQL             ;Restore old freq
        POP   TFREQH             ;
        RET
```

```
MDAH:  PUSH  TFREQH          ;Produces a dah
       PUSH  TFREQL          ;
       PUSH  PSW
       PUSH  A
       MOV   TFREQH,#0FEH    ;New freq for morse code
       MOV   TFREQL,#5FH     ;800Hz (TFREQ=65119)
       MOV   A,#03H          ;Dah length
       CALL  TONE            ;
       MOV   A,#01H          ;Inter dit-dah spacing
       CALL  DELAY           ;
       POP   A
       POP   PSW
       POP   TFREQL          ;Restore old freq
       POP   TFREQH          ;
       RET

MORSE: PUSH  A               ;Send ACC in morse code
       PUSH  PSW
       MOV   DPTR,#0030H     ;** 30H=MTABLE
       MOVC  A,@A+DPTR       ;ACC = ASCII(char)-48
       CLR   C               ;Morse pattern of char in A
       MOV   R4,#8H          ;Count the rotations
  MLP: RLC   A               ;Rotate left to start of morse code
       DJNZ  R4,MCONT1       ;Make sure we don't hang up
       JMP   MTHRU
MCONT1: JNC  MLP
  MCK: RLC   A               ;We are at beginning of bit pattern
       JC    MDA             ;See if dit (0) or dah (1)
       CALL  MDIT
       JMP   MCONT2
  MDA: CALL  MDAH
MCONT2: DJNZ R4,MCK          ;Are we done?
MTHRU: MOV   A,#04H          ;Inter-char spacing
       CALL  DELAY
       POP   PSW
       POP   A
       RET

;Interrupt Routines

  PFWI: CALL ALERT           ;Power Fail Interrupt
       MOV   A,#87H          ;Code for dead battery
```

```
        CALL  SEND
        MOV   A,#14H              ;Send 'DEAD'
        CALL  MORSE
        MOV   A,#15H
        CALL  MORSE
        MOV   A,#11H
        CALL  MORSE
        MOV   A,#14H
        CALL  MORSE
        RETI

  TOF0: PUSH  PSW                 ;Timer 0 Overflow Interrupt Routine
        PUSH  A
        CLR   TR0                 ;Stop Timer 0
        MOV   TH0,#7DH            ;Load TH0,TL0 with 32203
        MOV   TL0,#0CBH           ;for 8 MHz clock.
        SETB  TR0                 ;Interrupt every 50 mS
        SETB  RS0                 ;Switch to Bank 1
        CLR   RS1
        MOV   A,R0                ;If Rn=0, leave it there,
        JZ    TZ1                 ;otherwise, DEC R0, R1 and R2
        DEC   R0
  TZ1:  MOV   A,R1
        JZ    TZ2
        DEC   R1
  TZ2:  MOV   A,R2
        JZ    TZ3
        DEC   R2
  TZ3:  POP   A
        POP   PSW
        RETI

 XINT0: RETI                      ;External Interrupt 0 Routine
                                  ;(Batt A/D)

 XINT1: RETI                      ;External Interrupt 2
                                  ;(Low Battery Comparator)

  TOF1: JNB   PWM,TOLO            ;Timer 1 Overflow Interrupt
;                                  Routine (for BTEST)
        MOV   TH1,R6              ;Now high and counting, load next
;                                  low time
```

```
        CLR   PWM          ;Set A/D input high
        SETB  FL0
        RETI
TOLO:   MOV   TH1,R7       ;Now low and counting, load next
;                           high time
        SETB  PWM          ;Set A/D input low
        SETB  FL0
        RETI

TRXD:   RETI               ;Serial Port Interrupt Routine

.END
```

TABLE II

TRANSMISSION PROTOCOLS AND ASSOCIATED RECEIVER DISPLAYS

| Switch Status | | | | | | Action | Transmission | Display |
|---|---|---|---|---|---|---|---|---|
| S0 | S1 | S2 | S3 | S4 | S5 | | | |
| | | | | | 1 | System power on | Special Sequence | |
| | | | 2 | | 1 | System power off | 89 | .-. |
| | | 2 | | | 1 | Battery test | 82/MSD/LSD | .MSD..LSD. |
| | 2 | | | | 1 | Transmitter off | none | |
| 2 | | | | | 1 | Transmitter on | none | |
| 1 | | | | | | Volume up | 80/4MSB | .0 to .F |
| 1 | | 2 | | | | Volume up rapidly | same | same |
| | | 1 | | | | Volume down | same | same |
| 2 | | 1 | | | | Volume down rapidly | same | same |
| | 1 | | | | | To neck | 81/4MSB | 0.to F. |
| | 1 | | 2 | | | To neck rapidly | same | same |
| | | | 1 | | | To bridge | same | same |
| | 2 | | 1 | | | To bridge rapidly | same | same |
| | | 2 | | 1 | | Equalizer bypass | 83/14 | .A. |
| 2 | | | | 1 | | Reverb. option #1 | 83/11 | 1 |
| | 2 | | | 1 | | Reverb. option #2 | 83/12 | 2 |
| | | | 2 | 1 | | Reverb. option #3 | 83/18 | 3 |
| 3 | | | | 1 | 2 | Increment option | 83/31 | prior |
| | | 3 | | 1 | 2 | Decrement option | 83/34 | prior |
| | | | | 2 | 1 | Audio mute toggle | none | |
| | 3 | | | 1 | 2 | Reverb. normal/hold | 83/32 | .h |
| | | | 3 | 1 | 2 | Reverb. enable/bypass | 83/38 | b |

```
;These SFR's are not implemented
;in this version of the 8051 assembler.
      TA: EQU   0C7H    ;055H Timed Access  *DS5000*
    MCON: EQU   0C6H    ;RT   Memory Control *DS5000*
    PCON: EQU   087H    ;RT   Power Control

;P0 Port 0 = Seven Segment Display
;       L0: REG   P0.0    ;        ********
;       L1: REG   P0.1    ;        *  L1  *
;       L2: REG   P0.2    ;     L0 *      * L2
;       L3: REG   P0.3    ;        *  L4  *
;       L4: REG   P0.4    ;        ********
;       L5: REG   P0.5    ;     L3 *      * L5
;       L6: REG   P0.6    ;        *  L6  *
;       L7: REG   P0.7    ;  L7 *  ********  * L8

;P1 Port 1

;P2 Port 2
;         : REG   P2.0
;         : REG   P2.1
;         : REG   P2.2
;         : REG   P2.3
      AM: REG   P2.4    ;Active/Memory
     BYP: REG   P2.5    ;Bypass Relay
    HOLD: REG   P2.6    ;Hold Relay
;        : REG   P2.7    ;LED decimal (See P0)

;P3 Port 3
     RXD: REG   P3.0
     TXD: REG   P3.1
;   INT0: REG   P3.2
;   INT1: REG   P3.3
;     T0: REG   P3.4
;     T1: REG   P3.5
;     WR: REG   P3.6
;     RD: REG   P3.7

;IE Interrupt Enable Register
     EX0: REG   IE.0    ;External Interrupt 0
     ET0: REG   IE.1    ;Timer 0 Overflow
     EX1: REG   IE.2    ;External Interrupt 1
```

TABLE III

RECEIVER SIGNAL PROCESSING AND DISPLAY CONTROLLER PROGRAM

```
;These are the SFR locations in the 8051
;        B: REG   0F0H    ;00H  B Register
;        A: REG   0E0H    ;00H  Accumulator
;      PSW: REG   0D0H    ;00H  Program Status Word
;       IP: REG   0B8H    ;00H  Interrupt Priority
;       P3: REG   0B0H    ;0FFH Port 3
;       IE: REG   0A8H    ;00H  Interrupt Enable
;       P2: REG   0A0H    ;0FFH Port 2
;     SBUF: REG   099H    ;??   Serial Data Buffer
;     SCON: REG   098H    ;00H  Serial Control
;       P1: REG   090H    ;0FFH Port 1
;      TH1: REG   08DH    ;00H  Timer 1 High Byte
;      TH0: REG   08CH    ;00H  Timer 0 High Byte
;      TL1: REG   08BH    ;00H  Timer 1 Low Byte
;      TL0: REG   08AH    ;00H  Timer 0 Low Byte
;     TMOD: REG   089H    ;00H  Timer Mode Select
;     TCON: REG   088H    ;00H  Timer Control
;      DPH: REG   083H    ;00H  Data Pointer High Byte
;      DPL: REG   082H    ;00H  Data Pointer Low Byte
;       SP: REG   081H    ;07H  Stack Pointer
;       P0: REG   080H    ;0FFH Port 0


;These MACROS allow direct data moves to SFR's not
;implemented in this version of the 8051 assembler.

XMVI:     .MACRO        ARG1,ARG2        ;MOV  direct,#data
          .BYTE    075H,ARG1,ARG2        ;Moves data to direct
          .MACEND

XMAD:     .MACRO        ARG1             ;MOV  acc,direct
          .BYTE 0E5H,ARG1                ;Moves direct to A
          .MACEND

XMDA:     .MACRO        ARG1             ;MOV  direct,acc
          .BYTE 0F5H,ARG1                ;Moves A to direct
          .MACEND
```

```
     ET1: REG   IE.3    ;Timer 1 Overflow
      ES: REG   IE.4    ;Serial Port
;       : REG   IE.5    ;Not Used
;       : REG   IE.6    ;Not Used
      EA: REG   IE.7    ;Enable Interrupts

;IP Interrupt Priority Register
     PX0: REG   IP.0    ;External Interrupt 0
     PT0: REG   IP.1    ;Timer 0 Overflow
     PX1: REG   IP.2    ;External Interrupt 1
     PT1: REG   IP.3    ;Timer 1 Overflow
      PS: REG   IP.4    ;Serial Port
;       : REG   IP.5    ;Not Used
;       : REG   IP.6    ;Not Used
     RWT: REG   IP.7    ;Reset Watchdog Timer  *DS5000*


;TCON Timer Control Register
     IT0: REG   TCON.0  ;INT0 Falling edge/Low level 1/0
     IE0: REG   TCON.1  ;INT0 Edge Flag
     IT1: REG   TCON.2  ;INT1 Falling edge/Low level 1/0
     IE1: REG   TCON.3  ;INT1 Edge Flag
     TR0: REG   TCON.4  ;Timer 0 Run Control 1/0 Run/Stop
     TF0: REG   TCON.5  ;Timer 0 Overflow Flag
     TR1: REG   TCON.6  ;Timer 1 Run Control 1/0 Run/Stop
     TF1: REG   TCON.7  ;Timer 1 Overflow Flag


;SCON Serial Port Control Register
      RI: REG   SCON.0  ;Receive Interrupt Flag
      TI: REG   SCON.1  ;Transmit Interrupt Flag
     RB8: REG   SCON.2  ;9th Data Bit Received
     TB8: REG   SCON.3  ;9th Data Bit Transmitted
     REN: REG   SCON.4  ;Enable Serial Reception
     SM2: REG   SCON.5  ;Multiprocessor Communication Feature Enable
     SM1: REG   SCON.6  ;Serial Port Mode
     SM0: REG   SCON.7  ;Serial Port Mode

;PSW Program Status Word
;     CY: REG   PSW.0  ;Carry
;     AC: REG   PSW.1  ;Auxiliary Carry
     FL0: REG   PSW.2  ;General Purpose Flag
```

```
     RS1: REG   PSW.3  ;Register Bank Select Bit 1
     RS0: REG   PSW.4  ;Register Bank Select Bit 0
;     OV: REG   PSW.5  ;Overflow Flag
;      : REG   PSW.6  ;Not Used
;      P: REG   PSW.7  ;Parity Flag

;Bit Addressable
     KEY: REG   20H
   KEY.0: REG   20H.0
   KEY.1: REG   20H.1
   KEY.2: REG   20H.2
   KEY.3: REG   20H.3
   KEY.4: REG   20H.4

   KEY.5: REG   20H.5
   KEY.6: REG   20H.6
   KEY.7: REG   20H.7

     BLO: REG   21H.0   ;1=Bass Battery Low, blink display
   BLINK: REG   21H.1   ;Toggles at the blink rate
     DOT: REG   21H.2   ;Right decimal point. used with DISP
      CD: REG   21H.3   ;=1 We have carrier
     POR: REG   21H.4   ;=1 Until diagnostics are complete
;      : REG   21H.5
;      : REG   21H.6
;      : REG   21H.7

    DISP: REG   22H     ;Display. DOT holds right decimal point
  DISP.0: REG   22H.0
  DISP.1: REG   22H.1
  DISP.2: REG   22H.2
  DISP.3: REG   22H.3
  DISP.4: REG   22H.4
  DISP.5: REG   22H.5
  DISP.6: REG   22H.6
  DISP.7: REG   22H.7

    CARR: REG   23H     ;All 1'S=Carrier

    RPTR: REG   R0      ;Receive buffer Read Pointer
    WPTR: REG   R1      ;Receive Buffer Write Pointer
    PRGM: REG   R2      ;Active MIDI Program
```

```
    BUFN: REG   R3        ;# Of bytes in input buffer
.CODE

.ORG  00H
          JMP   MAIN
.ORG  03H
          JMP   XINT0
.ORG  0BH
          JMP   TOF0
.ORG  13H
          JMP   XINT1
.ORG  1BH
          JMP   TOF1
.ORG  23H
          JMP   TRXD
.ORG  2BH
          JMP   PFWI              ;Power Fail Interrupt

    MAIN: MOV   SP,#60H           ;Stack at 60H (32 Bytes)
          MOV   IE,#00H           ;Disable all interrupts
          SETB  POR
          SETB  PS                ;Set Serial INT =  high priority
          MOV   TMOD,#21H         ;Set up Timer 0 to generate
          CLR   TR0               ;real time clock.Timer 1= auto
          CLR   TF0               ;CLR R/S and OF flags
          CLR   TR1
          CLR   TF1
          MOV   SCON,#50H         ;Set Serial Port Control Register

          MOV   TH1,#0EFH         ;1.2K Baud @ 8Mhz Fck
          SETB  ET0               ;Enable Timer 0 Interrupt
          SETB  ES                ;Set serial interrupt
          SETB  EA                ;Enable Interrupts
          SETB  TR0               ;Start Timer 0
          SETB  TR1               ;Start timer 1
          XMAD  PCON              ;See if we had a no Vli reset
          MOV   R7,A              ;Save PCON in R7
          XMAD  MCON              ;
          XMVI  TA,0AAH           ;Timed Access Register
          XMVI  TA,055H           ;
          XMVI  PCON,01001000B    ;Enable EPFW,Disable EWT
          XRL   A,#11111010B      ;If MCON=11111010 and PCON=0,
```

```
      ADD   A,R7              ;we have a bad lithium battery
      JNZ   LIOK
      SETB  DOT
      MOV   DISP,#10001001B ;Show 'L'
      MOV   A,#60             ;Wait
      CALL  DELAY
LIOK: CLR   RS0
      CLR   RS1
      CLR   BLO
      CLR   BLINK
      MOV   CARR,#0FFH
      MOV   RPTR,#30H         ;Init read PTR
      MOV   WPTR,#30H         ;Init write PTR
      MOV   BUFN,#00H         ;Clear Buffer
      MOV   DISP,#00H         ;Lamp Test
      CLR   DOT
      MOV   A,#20
      CALL  DELAY
      MOV   DISP,#0FFH
      SETB  DOT
      MOV   A,#10H
      CALL  NUMBER
      MOV   A,#3
      CALL  DELAY
      MOV   DISP,#10010100B ;Show 'GLEnn'
      MOV   A,#3
      CALL  DELAY
      MOV   A,#10H
      CALL  NUMBER
      MOV   A,#3
      CALL  DELAY
      MOV   DISP,#10110110B
      MOV   A,#3
      CALL  DELAY
      MOV   A,#10H
      CALL  NUMBER
      MOV   A,#3
      CALL  DELAY
      MOV   DISP,#10100100B
      MOV   A,#3
      CALL  DELAY
      MOV   A,#10H
      CALL  NUMBER
```

```
        MOV   A,#3
        CALL  DELAY
        MOV   DISP,#11000111B
        MOV   A,#3
        CALL  DELAY
        MOV   A,#10H
        CALL  NUMBER
        MOV   A,#3
        CALL  DELAY
        MOV   DISP,#11000111B
        MOV   A,#3
        CALL  DELAY
        MOV   A,#10H
        CALL  NUMBER
        MOV   A,#3
        CALL  DELAY
        MOV   A,#00H            ;Program 0
        CALL  MIDI
        MOV   A,#0              ;Show '0'
        CALL  NUMBER
        CLR   POR
WAIT:   MOV   A,BUFN            ;Wait for incoming data
        JNZ   BUSY              ;JMP if no bytes in buffer
        SETB  RS0               ;Reset timeout timer
        MOV   R6,#4
        CLR   RS0
        JMP   WAIT
BUSY:   SETB  RS0               ;See if we timed out
        MOV   A,R6
        CLR   RS0
        JZ    ERR               ;Yes
        MOV   A,@RPTR           ;Get Char
        CJNE  A,#85H,LOBAT      ;BAD LITHIUM
        CALL  INCR
        MOV   DISP,#00110101B   ;Bad Li, show '.L.'
        CLR   DOT
        JMP   WAIT
ERR:    CALL  XERR
        JMP   WAIT
LOBAT:  CJNE  A,#86H,DDBAT      ;LOW BATTERY
        CALL  INCR
        SETB  BLO
```

```
PFWI: RETI

TOF0: PUSH  PSW      ;Timer 0 Overflow Interrupt Routine
      PUSH  A
      MOV   A,CARR
      MOV   C,RXD              ;See if we have a signal from rcvr
      RLC   A
      MOV   CARR,A             ;Carrier history in CARR
      XRL   A,#0FFH            ;Are they all 1's?
      JNZ   NOT1S
      SETB  CD                 ;Yes, set carrier detect
      JMP   NOT0S
NOT1S: MOV  A,CARR
      XRL   A,#00H             ;Are they all 0's?
      JNZ   NOT0S
      CLR   CD                 ;Yes, no carrier
NOT0S: CLR  TR0                ;Stop Timer 0
      MOV   TH0,#61H           ;Load TH0,TL0 with 25000
      MOV   TL0,#0A8H          ;for 6 MHz clock.
      SETB  TR0                ;Interrupt every 50 mS .
      SETB  RS0                ;Switch to Bank 1
      CLR   RS1
      MOV   A,R7               ;If Rn=0, leave it there,
      JZ    TZ0                ;otherwise, DEC R7,R6,R5
      DEC   R7                 ;R7 is for the delay routine
  TZ0: MOV  A,R6
      JZ    TZ1
      DEC   R6                 ;R6 is timeout timer
  TZ1: DJNZ R5,UPDTE           ;R5 is timer for blinking
      MOV   R5,#2              ;Blink rate
      CPL   BLINK
UPDTE: MOV  C,POR              ;Show diagnostics
      JC    NORM
      MOV   C,CD               ;Do we have a carrier?
      JNC   NOCAR              ;No, blank display
      MOV   C,BLO              ;Update display
      JNC   NORM               ;If BLO=0, blink display
      MOV   C,BLINK            ;we're supposed to blink
      JC    NORM               ;Its lit
      MOV   P0,#0FFH
      SETB  P2.7               ;Its off
      POP   A
```

```
        MOV   DISP,#00000110B  ;Low batt, show '.b.'
        CLR   DOT
        JMP   WAIT
DDBAT:  CJNE  A,#87H,PRUP      ;DEAD BATTERY
        CALL  INCR
        MOV   DISP,#00000011B  ;Dead batt, show '.d.'
        CLR   DOT
        JMP   WAIT
 PRUP:  CJNE  A,#88H,PRDN      ;POWER UP
        CALL  INCR
        CLR   BLO
        MOV   DISP,#01111010B  ;Bass powered up, show '.".'
        CLR   DOT
        JMP   WAIT
 PRDN:  CJNE  A,#89H,VOL       ;POWER DOWN
        CALL  INCR
        MOV   DISP,#01101111B  ;Bass powered down, show '.-.'
        CLR   DOT
        MOV   A,#10
        CALL  DELAY            ;Delay so you can see it
        JMP   WAIT
  VOL:  CJNE  A,#80H,BAL       ;VOLUME. 2 Byte message
        MOV   A,BUFN           ;See if all bytes are in.
        CLR   C
        SUBB  A,#02
        JC    ERRV             ;Nope, Start timeout
        CALL  INCR
        MOV   A,@RPTR          ;Get volume byte
        CALL  INCR
        CALL  NUMBER
        CLR   DISP.7           ;Display '.V '
        SETB  DOT
 ERRV:  JMP   WAIT
  BAL:  CJNE  A,#81H,BATTV     ;BALANCE. 2 Byte message
        MOV   A,BUFN           ;See if all bytes are in.
        CLR   C
        SUBB  A,#02
        JC    ERRB             ;Nope, Start timeout
        CALL  INCR
        MOV   A,@RPTR          ;Get balance byte
        CALL  INCR
        CALL  NUMBER
```

```
        SETB  DISP.7          ;Display '.B '
        CLR   DOT
ERRB:   JMP   WAIT
BATTV:  CJNE  A,#82H,FNCN     ;Batt V. 3 Byte message
        MOV   A,BUFN          ;See if all bytes are in.
        CLR   C
        SUBB  A,#03
        JC    ERRT            ;Nope, Start timeout
        PUSH  DISP            ;Save old display
        PUSH  P2
        CALL  INCR
        MOV   A,@RPTR         ;Get Batt MSB
        CALL  INCR
        CALL  NUMBER
        CLR   DISP.7          ;Display '.V. '
        CLR   DOT
        MOV   A,#20
        CALL  DELAY
        MOV   A,@RPTR         ;Get Batt LSB
        CALL  INCR
        CALL  NUMBER
        CLR   DISP.7          ;Display '.V. '
        CLR   DOT
        MOV   A,#20
        CALL  DELAY
        POP   P2              ;Restore old display
        POP   DISP
ERRT:   JMP   WAIT
FNCN:   CJNE  A,#83H,DUN      ;FUNCTION. 2 Byte message
        MOV   A,BUFN          ;See if all bytes are in.
        CLR   C
        SUBB  A,#02
        JC    ERRF            ;Nope, Start timeout
        CALL  INCR
        MOV   A,@RPTR         ;Get Keys
        CALL  INCR
        JMP   CKFN
ERRF:   JMP   WAIT
CKFN:   MOV   KEY,A           ;Get key status in KEY
        MOV   C,KEY.4         ;Is F4 pressed?
        JNC   DUN             ;Function key not pressed, RTN
        MOV   C,KEY.5         ;Is F5 pressed
```

```
      JNC   FKY0          ;No, Continue
      JMP   AFKY0         ;Yes, jump to alternate functions
DUN:  JMP   WAIT
FKY0: MOV   C,KEY.0       ;F0=Program
      JNC   FKY1
      MOV   A,#00H        ;0
      CALL  MIDI
      CALL  NUMBER        ;Show program number
      SETB  DOT
      JMP   WAIT
FKY1: MOV   C,KEY.1       ;F1=Program
      JNC   FKY2
      MOV   A,#01H        ;1
      CALL  MIDI
      CALL  NUMBER        ;Show program number
      SETB  DOT
      JMP   WAIT
FKY2: MOV   C,KEY.2       ;F2=A/M PULSE
      JNC   FKY3
      CLR   AM
      MOV   A,#1
      CALL  DELAY
      SETB  AM
      PUSH  DISP
      MOV   A,#0AH        ;Show 'A'
      CALL  NUMBER
      SETB  DOT
      MOV   A,#6
      CALL  DELAY
      POP   DISP
      JMP   WAIT
FKY3: MOV   C,KEY.3       ;F3=Program
      JNC   DUN3
      MOV   A,#02H        ;2
      CALL  MIDI
      CALL  NUMBER        ;Show program number
      SETB  DOT
DUN3: JMP   WAIT
AFKY0: MOV  C,KEY.0       ;ALT F0=INCR PROGRAM
      JNC   AFKY1
      MOV   A,PRGM        ;Incr Program
      INC   A
```

```
        ANL   A,#0FH
        MOV   PRGM,A
        CALL  MIDI
        CALL  NUMBER            ;Show program number
        SETB  DOT
        JMP   WAIT
AFKY1:  MOV   C,KEY.1           ;ALT F1=toggle K1
        JNC   AFKY2             ;  =Bypass
        CPL   BYP
        PUSH  DISP
        MOV   A,#0BH            ;Show 'B'
        CALL  NUMBER
        SETB  DOT
        MOV   A,#6
        CALL  DELAY
        POP   DISP
        JMP   WAIT
AFKY2:  MOV   C,KEY.2           ;ALT F2=DECR PROGRAM
        JNC   AFKY3
        MOV   A,PRGM            ;Decr Program
        DEC   A
        ANL   A,#0FH
        MOV   PRGM,A
        CALL  MIDI
        CALL  NUMBER            ;Show program number
        SETB  DOT
        JMP   WAIT
AFKY3:  MOV   C,KEY.3           ;ALT F3=toggle K2
        JNC   ADUN3             ;      =Hold
        CPL   HOLD
        PUSH  DISP
        MOV   DISP,#11000010B   ;Show 'H'
        SETB  DOT
        MOV   A,#6
        CALL  DELAY
        POP   DISP
ADUN3:  JMP   WAIT

INCR:   CLR   ES      ;Incr RPTR
        PUSH  PSW
        PUSH  A
        CLR   RS0
```

```
        CLR   RS1
        MOV   A,RPTR
        INC   A
        ANL   A,#0FH
        ADD   A,#30H
        MOV   RPTR,A
        DEC   BUFN
        MOV   A,BUFN
        CLR   C
        RLC   A
        JNC   INRG    ;Is # of bytes in buffer negative?
        CALL  XERR
  INRG: POP   A
        POP   PSW
        SETB  ES
        RET

NUMBER: SETB  DOT                    ;Show ACC on display (0-F)
        CJNE  A,#00H,N1
        MOV   DISP,#10010000B        ;'0'
        RET
    N1: CJNE  A,#01H,N2
        MOV   DISP,#11011011B        ;'1'
        RET
    N2: CJNE  A,#02H,N3
        MOV   DISP,#10100001B        ;'2'
        RET
    N3: CJNE  A,#03H,N4
        MOV   DISP,#10001001B        ;'3'
        RET
    N4: CJNE  A,#04H,N5
        MOV   DISP,#11001010B        ;'4'
        RET
    N5: CJNE  A,#05H,N6
        MOV   DISP,#10001100B        ;'5'
        RET
    N6: CJNE  A,#06H,N7
        MOV   DISP,#10000100B        ;'6'
        RET
    N7: CJNE  A,#07H,N8
        MOV   DISP,#11011001B        ;'7'
        RET
```

```
N8: CJNE  A,#08H,N9
    MOV   DISP,#10000000B        ;'8'
    RET
N9: CJNE  A,#09H,NA
    MOV   DISP,#10001000B        ;'9'
    RET
NA: CJNE  A,#0AH,NB
    MOV   DISP,#11000000B        ;'A'
    RET
NB: CJNE  A,#0BH,NC
    MOV   DISP,#10000110B        ;'b'
    RET
NC: CJNE  A,#0CH,ND
    MOV   DISP,#10110100B        ;'C'
    RET
ND: CJNE  A,#0DH,NE
    MOV   DISP,#10000011B        ;'d'
    RET
NE: CJNE  A,#0EH,NF
    MOV   DISP,#10100100B        ;'E'
    RET
NF: CJNE  A,#0FH,NG
    MOV   DISP,#11100100B        ;'F'
    RET
NG: MOV   DISP,#FFH              ;' '
    RET

XERR: CLR   ES

      PUSH  PSW
      CLR   RS0
      CLR   RS1
      MOV   DISP,#00100100B      ;Xmit Error, show '.E.'
      CLR   DOT
      MOV   RPTR,#30H
      MOV   WPTR,#30H            ;Reset buffer PTR
      MOV   BUFN,#00H            ;Reset # of bytes in buffer
      CLR   RI
      POP   PSW
      SETB  ES
      RET
```

```
MIDI: CLR   EA                  ;Send A as Program to MIDI Port
      PUSH  A
      CLR   TR1                 ;Disable Serial port interrupt
      XMVI  TA,0AAH             ;Timed Access Register
      XMVI  TA,055H             ;
      XMVI  PCON,11000000B      ;SETB SMOD Double baud rate
      MOV   TH1,#0FFH           ;31.25K Baud @ 6Mhz Fck
      SETB  TR1                 ;Start timer
      CLR   TI                  ;CLR Xmit Interrupt Flag
      MOV   SBUF,#0C0H          ;Send Program Change Code
SWT1: JNB   TI,SWT1             ;Wait until sent
      CLR   TI
      MOV   SBUF,A              ;Send A
SWT2: JNB   TI,SWT2             ;Wait until sent
      CLR   TI                  ;CLR Xmit Interrupt Flag
      CLR   TR1                 ;Stop timer
      XMVI  TA,0AAH             ;Timed Access Register
      XMVI  TA,055H             ;
      XMVI  PCON,01001000B      ;CLR SMOD Reset double baud
;                                rate
      MOV   TH1,#0F3H           ;1.2K Baud @ 6Mhz Fck
      SETB  TR1                 ;Start timer
      POP   A
      SETB  EA                  ;Set serial interrupt
      RET

DELAY: PUSH PSW                 ;Delay for A/20 Seconds.
       PUSH A                   ;Save arg
       SETB RS0                 ;Switch to Bank 1 to read clock
       CLR  RS1
       MOV  R7,A                ;Put time in R7.
DWAIT: MOV  A,R7                ;Sit here until R7 becomes 0
       JNZ  DWAIT               ;(The TF0 Routine is keeping
;                                time)
       POP  A
       POP  PSW
       RET

;Interrupt Routines
XINT0: RETI          ;External Interrupt 0 Routine
XINT1: RETI
 TOF1: RETI
```

```
        POP   PSW
        RETI
NORM:   MOV   P0,DISP                ;Update display
        MOV   C,DOT
        MOV   P2.7,C
        POP   A
        POP   PSW
        RETI
NOCAR:  MOV   P0,#07FH               ;No carrier, show ". ."
        CLR   P2.7
        POP   A
        POP   PSW
        RETI
TRXD:   CLR   ES       ;Serial Port Interrupt Routine
        PUSH  PSW
        PUSH  A
        CLR   RS0
        CLR   RS1
        MOV   A,SBUF
        CLR   RI                     ;We've received a byte from the
        MOV   @WPTR,A                ;Write it at write PTR
        MOV   A,WPTR                 ;Bump pointer
        INC   A
        ANL   A,#0FH                 ;Allow only 16 entries
        ADD   A,#30H                 ;30H is Base
        MOV   WPTR,A                 ;save it
        INC   BUFN                   ;incr # OF bytes in buffer
        POP   A
        POP   PSW
        SETB  ES
        RETI

.END
```

What is claimed is:

1. In combination:

a portable musical instrument having audio-frequency vibration-sensing means responsive to sound-indicating vibrations from said instrument for converting said vibrations into sound-indicating electrical signals;

communication means for communicating said sound-indicating signals to remote audio amplifier means adapted for connection to loudspeaker means;

user-operable first alteration means affixed to said instrument and operable over a range of states for altering said sound-indicating signals over a corresponding range of signal alterations;

generating means associated with said instrument for generating a range of status-indicating electrical signal conditions indicative of the chosen state of said first alteration means;

visual display means adapted for placement remote from said instrument for providing a readily visible indication at the remote location from where the operator is playing the instrument and powered by a source remote from said instrument for producing a plurality of different display conditions; and display control means responsive to said status-indicating signal conditions for selectively actuating said display means to produce a display condition indicative of said chosen state of operation of said instrument.

2. In combination:

a portable musical instrument having audio-frequency vibration-sensing means responsive to sound-indicating vibrations from said instrument for converting said vibrations into sound-indicating electrical signals, said vibration-sensing means including at least two vibration sensors, each sensor responding to the vibration sensed thereat and producing a corresponding sound-indicating electrical signal condition;

user-operable first alteration means affixed to said instrument and operable over a range of states for altering said sound-indicating signals over a corresponding range of signal alterations and including user-operable volume control means operable over a range of states for varying the strength of the sum of said sound-indicating electrical signal conditions and user-operable fader means operable over a range of states for controllably adjusting the relative strengths of said corresponding sound-indicating signal conditions;

communication means for communicating said sound-indicating signals to remote audio amplifier means adapted for connection to loudspeaker means;

generating means associated with said instrument for generating a range of status-indicating electrical signal conditions indicative of the chosen states of said volume control means and said fader control means;

visual display means adapted for placement remote from said instrument for providing a readily visible indication at the remote location from where the operator is playing the instrument and powered by a source remote from said instrument for producing a plurality of different status-indicating display conditions; and display control means responsive to said status-indicating signal conditions for selectively actuating said display means to produce unique display conditions indicative of the state of said volume control means and said fader control means.

3. A portable musical instrument comprising:

audio-frequency vibration-sensing means responsive to sound-indicating vibrations from said instrument for converting said vibrations into sound-indicating electrical signals;

communication means for communicating said sound-indicating signals to remote audio amplifier means adapted for connection to loudspeaker means;

user-operable volume control means affixed to said instrument and operable over a range of states to vary the strength of said sound-indicating signals;

generating means affixed to said instrument for generating a range of status-indicating electrical signal conditions indicative of the chosen state of said volume control means; and user-operable command scenting means affixed to said instrument for selectively generating signal-altering commands for transmission via said communication means to audio processing means remote from said instrument and adapted for connection to said amplifier means and operable among a plurality of sound-altering modes for altering the audio signals sent to said loudspeaker means in a plurality of ways responsively to receipt of said signal-altering commands.

4. A portable musical instrument comprising:

audio-frequency vibration-sensing means responsive to sound-indicating vibrations from said instrument for converting said vibrations into sound-indicating electrical signals;

communication means for communicating said sound-indicating signals to remote audio amplifier means adapted for connection to loudspeaker means;

user-operable first alteration means affixed to said instrument and operable over a range of states for altering said sound-indicating signals over a corresponding range of signal alterations;

generating means affixed to said instrument for generating a range of status-indicating electrical signal conditions indicative of the chosen state of said first alteration means; and user-operable command selecting means affixed to said instrument and operatively controlling said generating means for selectively generating signal-altering commands for transmission via said communication means to audio processing means adapted for connection to said amplifier means for altering the audio signals sent to said loudspeaker means in a plurality of ways responsively to receipt of said signal-altering commands.

5. The instrument of claim 3 including indicator means responsive to said status-indicating signal conditions and said signal-altering commands for providing an indication of currently chosen volume states and currently selected signal-altering commands.

6. The instrument of claim 4 including remotely powered indicator means including luminous display means disposable at a location remote from said instrument for providing a plurality of different readily visible indications at the remote location where the operator is playing the instrument and visible to the operator; and display control means responsive to said status-indicating signal conditions and said signal-altering commands for operating said display means to provide distinguishing indications of currently chosen signal alteration conditions and currently selected signal-altering commands.

7. The instrument or combination of claims 1 or 5 further including terminal and support means adapted for connection to and support of first battery means on said instrument for supplying power to said generating means.

8. The instrument or combination of claim 7 wherein said communication means includes wireless transmitter means powered by said first battery means and responsive to said altered sound-indicating signals and said status-indicating signals for generating and broadcasting signals containing representations thereof, and said amplifier means has associated therewith wireless receiver means for supplying replicas of said altered sound-indicating signals to said loudspeaker means and said status-indicating signals to said display control means.

9. The instrument or combination of claim 8 wherein said generating means includes user-operable means for selectively generating a plurality of signal-altering commands for transmission to said amplifier means to controllably operate audio processing means operatively associated with said amplifier means among a plurality of sound-altering modes responsively to receipt thereof, said transmitter means includes means responsive to said signal-altering commands for broadcasting signals containing replicas thereof, and said receiver means includes means for supplying replicas of said signal-altering commands to said audio processing means.

10. The instrument of claim 8 wherein said generating means includes user-operable means for selectively generating a plurality of signal-altering commands for transmission to said amplifier means to controllably operate audio processing means operatively associated with said amplifier means among a plurality of sound-altering modes responsively to receipt thereof.

11. The combination of claim 8 wherein said first alteration means includes user-operable volume control means operable over a range of states for varying the strength of said sound-indicating electrical signal conditions, said generating means includes means for generating status-indicating signal conditions indicative of the state of said volume control means, and said display control means includes means for operating said display means to produce display conditions indicative of said volume control means state.

12. The combination or instrument of claim 1 wherein said vibration-sensing means includes at least two vibration sensors, each sensor responding to the vibration sensed thereat and producing a corresponding sound-indicating electrical signal condition, said first alteration means includes user-operable fader means operable over a range of states for controllably adjusting the relative strengths of said corresponding signal conditions for transmission by said communication means to said audio amplifier means, said generating means includes means for generating status-indicating signal conditions indicative of the state of said fader control means, and said display control means includes means for producing display conditions indicative of said fader means state.

13. The instrument of claims 1 or 2 wherein said display or indicator means includes light-emitting display means adapted for placement remote from said instrument and visible to the operator and including a plurality of elements individually actuatable to a readily visible condition in chosen combinations, and means responsive to receipt of said status-indicating signal conditions for actuating a chosen combination of said elements to provide a display condition indicative of the status condition of said instrument and means responsive to receipt of said sound-altering commands for actuating a chosen different combination of said elements to provide display condition indicative of the signal-altering command sent.

14. The instrument or combination of claim 8 wherein said display control means includes means responsive to loss of signal capture by said receiver means for producing a unique display condition indicative thereof.

15. The instrument or combination of claim 8 wherein said generating means includes means for producing a range of battery-voltage-indicating signal conditions indicative of the voltage developed by said first battery means for transmission to said amplifier means, and means responsive to receipt of said first battery means battery-voltage-indicating conditions by said receiver means for operating said display or indicating means to produce display conditions indicative of said voltage.

16. The instrument or combination of claims 1, 2, 3 or 4 wherein said generating means are affixed to said instrument.

17. The instrument or combination of claim 9 wherein said generating means includes means for producing said status-indicating signal conditions as ultrasonic electrical signal conditions and means for adding them to said altered sound-indicating electrical signals for transmission by said transmitter means.

18. The combination of claims 1 or 2, wherein said display control means includes a display control microprocessor responsive to said signal-altering commands to produce command signals corresponding thereto for transmission to operate said audio processing means, said display control microprocessor is powered at least in part by a sealed battery internal thereto, said generating means includes means for generating a warning signal condition indicative of a low-battery state of said sealed battery, and said display control means includes means responsive to receipt of said warning signal condition for operating said display means to a condition indicative of said low-battery state.

19. The instrument or combination of claim 8 in combination with said amplifier means and said audio processing means.

20. The instrument or combination of claims 1, 2, 5 or 6 wherein said instrument is an electric guitar.

21. The instrument or combination of claim 8 in combination with said receiver means.

22. The instrument or combination of claims 1, or 5 wherein said display or indicator means includes light-emitting display means including a plurality of elements individually actuatable to a readily visible condition in chosen combination, said display control means responding to receipt of said status-indicating signals condition to actuate a chosen combination of said elements to provide said display condition indicative of the status condition of said instrument.

23. The instrument or combination of claim 9 wherein said display control means includes means responsive to receipt of said signal-altering commands by said amplifier means for producing display conditions indicative of the last signal-altering command received.

24. The instrument or combination of claim 23 wherein said display means includes light-emitting display means including a plurality of elements individually actuatable to a readily visible condition in chosen combination, and said display control means includes means responsive to receipt of said status-indicating signal conditions for actuating a chosen combination of said elements to provide said display condition indicative of the status condition of said instrument and means responsive to receipt of said signal-altering commands for actuating a chosen different combination of said elements to provide display condition indicative of the signal-altering command sent.

25. The combination of claim 2 wherein said generating means includes microprocessor-based control means carried within said instrument and operating according to a program stored therein, and including converter means for varying said strength of said sound-indicating electrical conditions responsively to binary volume commands received from said instrument microprocessor, and a plurality of switches connected to be sensed by said instrument microprocessor, said microprocessor-based control means including means responsive to actuation of switches for causing said instrument microprocessor to vary said volume commands to increase or decrease the strength of said sound-indicating signal conditions.

26. The combination of claim 25 wherein said instrument microprocessor is powered at least in part by a sealed battery internal thereto, said generating means includes means for generating a warning signal condition indicative of a low-battery state of said sealed battery, and said display control means includes means responsive to receipt of said warning signal condition for operating said display means to a condition indicative of said low-battery state.

27. The combination of claim 2 wherein said generating means includes microprocessor-based control means affixed to said instrument and operating according to a program stored therein, multiplying digital-to-analogue converter means connected to vary said relative strengths of said corresponding signal conditions according to binary volume commands received from said instrument microprocessor, and a plurality of switches connected to be sensed by said instrument microprocessor, actuation of certain of said switches in a given sequence causing said instrument microprocessor to vary said relative strengths to increase or decrease with respect to each other.

28. The combination of claim 27 wherein said instrument microprocessor is powered at least in part by a sealed battery internal thereto, said generating means includes means for generating a warning signal condition indicative of a low-battery state of said sealed battery, and said display control means includes means responsive to receipt of said warning signal condition for operating said display means to a condition indicative of said low-battery state.

29. The instrument or combination of claim 7 wherein said generating means includes means responsive to the voltage of said first battery means for producing a low-battery-indicating signal condition for transmission to said display means and indicating that the voltage developed by said battery means is below a given level, and said display control means includes means responsive to receipt of said low-battery-indicating signal conditions for operating said display means to produce display conditions indicative of said low voltage condition.

30. The instrument or combination of claim 29 wherein said display control means includes means responsive to receipt of said low-battery-indicating signal condition for actuating said display means to a continuously flashing state during subsequently generated display conditions.

31. The instrument or combination of claim 8 wherein said generating means includes a plurality of switches affixed to said instrument in a closely spaced array, and means for operating said first alteration means to a chosen state and for generating chosen signal-altering commands responsively to operation of chosen switches of said array.

32. The instrument or combination of claim 31 wherein said switches are in the form of a plurality of isolated conductors accessible to touch by the operator, and said generating means is configured to respond to selective touching of said conductors to selectively vary the status of said signal-altering means and to selectively generate chosen command signal conditions.

33. The instrument or combination of claim 31 wherein said generating means includes means responsive to single operation of chosen ones of said switches to establish chosen status conditions of said signal-altering means.

34. The instrument or combination of claim 31 wherein said generating means includes means responsive to sequential operation of chosen pluralities of said switches establish chosen status conditions of said signal-altering means.

35. The instrument or combination of claims 1, 2, 5 or 6 wherein said generating means includes a plurality of switches affixed to said instrument in a closely spaced array, and means for operating said first alteration means to a chosen state responsively to operation of chosen switches of said array.

36. The instrument or combination of claim 35 wherein said generating means includes means responsive to single operation of chosen ones of said switches to establish chosen status conditions of said signal-altering means.

37. The instrument or combination of claim 35 wherein said generating means includes means responsive to sequential operation of chosen pluralities of said switches establish chosen status conditions of said signal-altering means.

38. In combination:

a portable musical instrument having audio-frequency vibration-sensing means responsive to sound-indicating vibrations from said instrument for converting said vibrations into sound-indicating electrical signals;

cordless transmitter means affixed to said instrument for communicating said sound-indicating signals to remote receiver means adapted for connection to loudspeaker means;

terminal and support means adapted for connection to and support of first battery means on said instrument for supplying power to said transmitter means;

generating means affixed to said instrument and responsive to the voltage produced by said first battery means for generating a voltage-status-indicating electrical signal condition indicative of a battery voltage below a given level for transmission by said transmitter;

visual display means adapted for placement remote from said instrument and powered by a source remote from said instrument for producing a plurality of different display conditions; and display control means associated with said receiver means for operating said display means to produce a unique low-voltage-indicating display condition responsively to receipt of said voltage-status-indicating signal condition by said receiver means.

39. The combination of claim 38 wherein said cordless transmitter means includes a radio frequency transmitter, and said receiver means includes radio frequency receiver means for receiving said sound-indicating signals for transmission to said loudspeaker means and said voltage-status-indicating signal for transmission to said display control means.

40. The combination of claim 39 wherein said display means includes a plurality of elements individually actuatable to a readily visible condition in chosen combination, and said display control means includes means responsive to receipt of said voltage-status-indicating signal condition to operate said display means to actuate a chosen combination of said elements state to provide a low-battery warning to the operator.

41. The combination of claim 40 wherein said display means includes means responsive to receipt of said voltage-status-indicating signal condition for operating said display means to a continuously flashing state.

42. In combination:

a portable musical instrument having audio-frequency vibration-sensing means responsive to sound-indicating vibrations from said instrument for converting said vibrations into sound-indicating electrical signals;

cordless transmitter means affixed to said instrument for communicating said sound-indicating signals to remote receiver means adapted for connection to loudspeaker means;

terminal and support means adapted for connection to and support of first battery means on said instrument for supplying power to said generating means;

user-operable first alteration means affixed to said instrument and operable over a range of states for altering said sound-indicating signals over a corresponding range of signal alterations;

generating means associated with said instrument for generating a range of status-indicating electrical signal conditions indicative of the chosen state of said first alteration means;

detecting means associated with said generating means and responsive to the voltage produced by said battery for generating a voltage-status-indicating electrical signal condition indicative of a battery voltage below a given level for transmission by said transmitter;

visual display means adapted for placement remote from said instrument to be visible to the operator and powered by a source remote from said instrument for producing a plurality of different display conditions; and display control means associated with said receiver means and including means responsive to said status-indicating signal conditions for selectively actuating said display means to produce a display condition indicative of said chosen setting.

43. The combination of claim 42 wherein said display control means includes means for operating said display means to produce a low-voltage-indicating display condition responsively to receipt of said voltage-status-indicating signal condition by said receiver means.

44. The combination of claim 42 wherein said display means includes light-emitting display means including a plurality of elements individually actuatable to a readily visible condition in chosen combination, said display control means including means responsive to receipt of said status-indicating signal conditions to actuate a chosen combination of said elements to provide said display condition indicative of the status condition of said instrument and means for operating said elements to produce a unique low-voltage-indicating display condition responsively to receipt of said voltage-status-indicating signal condition by said receiver means.

45. The combination of claims 42 wherein said display control means includes means responsive to receipt of said battery-status-indicating signal condition for actuating said display means to a continuously flashing state during subsequently generated display conditions.

* * * * *